US010302262B2

(12) United States Patent
Huang et al.

(10) Patent No.: US 10,302,262 B2
(45) Date of Patent: May 28, 2019

(54) LED TROFFER LENS ASSEMBLY MOUNT

(71) Applicant: Cree, Inc., Durham, NC (US)

(72) Inventors: Yaote Huang, Morrisville, NC (US); James Hugh Bowden, Jr., Fuquay-Varina, NC (US); Curt Progl, Raleigh, NC (US)

(73) Assignee: Cree, Inc., Durham, NC (US)

( * ) Notice: Subject to any disclaimer, the term of this patent is extended or adjusted under 35 U.S.C. 154(b) by 2 days.

(21) Appl. No.: 15/469,868

(22) Filed: Mar. 27, 2017

(65) Prior Publication Data

US 2018/0224079 A1 Aug. 9, 2018

Related U.S. Application Data

(63) Continuation-in-part of application No. 15/425,371, filed on Feb. 6, 2017.

(51) Int. Cl.

| | |
|---|---|
| ***F21S 8/02*** | (2006.01) |
| ***F21S 8/04*** | (2006.01) |
| ***F21V 3/02*** | (2006.01) |
| ***F21V 17/10*** | (2006.01) |
| ***F21Y 115/10*** | (2016.01) |

(52) U.S. Cl.

CPC ..... *F21S 8/026* (2013.01); *F21S 8/04* (2013.01); *F21V 3/02* (2013.01); *F21V 17/105* (2013.01); *F21Y 2115/10* (2016.08)

(58) Field of Classification Search

CPC ..... F21V 17/105; F21S 8/026

See application file for complete search history.

(56) References Cited

U.S. PATENT DOCUMENTS 3,350,557 A * 10/1967 Szymanski ..... F21S 41/29 362/355
3,355,583 A * 11/1967 Sellenraad ..... E05C 19/16 362/433
3,593,021 A * 7/1971 Auerbach ..... F21V 17/105 362/434
3,696,238 A * 10/1972 Szymanski ..... F21S 48/1131 359/549
5,167,087 A * 12/1992 Plumly ..... G09F 7/04 40/600

(Continued)

OTHER PUBLICATIONS

U.S. Appl. No. 15/226,992, filed Aug. 3, 2016.

(Continued)

*Primary Examiner* — Alexander K Garlen

(74) *Attorney, Agent, or Firm* — Myers Bigel, P.A.

(57) ABSTRACT

A light fixture includes a LED assembly and a housing. A first end cap is permanently connected to the troffer. A lens assembly comprises a lens covering the LED assembly and a second end cap, the lens having a first end connected to the second end cap and a second end releasably connected to the first end cap. The second end cap is releasably connected to the housing such that the lens and the second end cap are releasably mounted to the housing as a unit. The lens has a first longitudinal edge and a second longitudinal edge where a first magnetic strip is attached to the first longitudinal edge and a second magnetic strip is attached to the second longitudinal edge. The first and second magnetic strips are magnetically adhered to the housing.

17 Claims, 25 Drawing Sheets

(56) References Cited

U.S. PATENT DOCUMENTS 5,174,056 A * 12/1992 King ..... D06C 3/08 267/180
7,481,552 B2 1/2009 Mayfield, III et al.
7,510,305 B2 * 3/2009 Straton ..... F21S 8/04 362/223
8,736,186 B2 5/2014 Chobot
8,829,821 B2 9/2014 Chobot et al.
8,912,735 B2 12/2014 Chobot et al.
8,975,827 B2 3/2015 Chobot et al.
9,155,165 B2 10/2015 Chobot
9,155,166 B2 10/2015 Chobot
9,433,061 B2 8/2016 Chobot
9,572,226 B2 2/2017 Motley et al.
2007/0037013 A1 * 2/2007 Svensson ..... B32B 5/16 428/692.1
2007/0183148 A1 * 8/2007 Mayfield, III ..... F21V 5/02 362/223
2007/0183154 A1 * 8/2007 Robson ..... F21V 3/04 362/267
2007/0247414 A1 * 10/2007 Roberts ..... F21K 9/00 345/102
2008/0298056 A1 * 12/2008 Petersen ..... F21V 5/007 362/235
2010/0091484 A1 4/2010 Mayfield, III et al.
2010/0128485 A1 * 5/2010 Teng ..... F21V 5/00 362/294
2014/0160742 A1 * 6/2014 Rodgers ..... F21V 23/02 362/222
2014/0204572 A1 * 7/2014 Spinelli ..... F21V 15/013 362/223
2014/0268790 A1 9/2014 Chobot et al.
2014/0355272 A1 12/2014 Chou
2015/0062913 A1 * 3/2015 Howe ..... F21V 5/002 362/294
2015/0102729 A1 4/2015 Creasman et al.
2015/0159839 A1 * 6/2015 Howe ..... F21V 3/0625 362/311.01
2015/0276125 A1 * 10/2015 Pratt ..... F21S 2/005 362/217.15
2016/0116118 A1 * 4/2016 Bernard ..... F21S 8/026 362/224
2017/0205036 A1 * 7/2017 Sorensen ..... F21S 8/026

OTHER PUBLICATIONS

U.S. Appl. No. 61/932,058, filed Jan. 27, 2014.
U.S. Appl. No. 62/292,528, filed Feb. 8, 2016.
U.S. Appl. No. 15/425,371, Office Action, dated Mar. 29, 2018.

* cited by examiner

LED TROFFER LENS ASSEMBLY MOUNT

This application is a continuation-in-part (CIP) of U.S. application Ser. No. 15/425,371, as filed on Feb. 6, 2017, which is incorporated by reference herein in its entirety.

BACKGROUND OF THE INVENTION

The invention relates to lighting fixtures and, more particularly, to indirect, direct, and direct/indirect lighting troffers that are well-suited for use with solid state lighting sources, such as light emitting diodes (LEDs).

Troffer-style fixtures are ubiquitous in residential, commercial, office and industrial spaces throughout the world. In many instances these troffer-style fixtures include troffers that house elongated fluorescent light bulbs that span the length of the troffer. Troffers may be mounted to or suspended from ceilings. Often the troffer may be recessed into the ceiling, with the back side of the troffer protruding into the plenum area above the ceiling. Elements of the troffer on the back side may dissipate heat generated by the light source into the plenum where air can be circulated to facilitate the cooling mechanism.

More recently, with the advent of efficient solid state lighting sources, these troffers have been used with LEDs. LEDs are solid state devices that convert electric energy to light and generally comprise one or more active regions of semiconductor material interposed between oppositely doped semiconductor layers. When a bias is applied across the doped layers, holes and electrons are injected into the active region where they recombine to generate light. Light is produced in the active region and emitted from surfaces of the LED.

LEDs have certain characteristics that make them desirable for many lighting applications that were previously the realm of incandescent or fluorescent lights. LEDs can emit the same luminous flux as incandescent and fluorescent lights using a fraction of the energy. In addition, LEDs can have a significantly longer operational lifetime.

SUMMARY OF THE INVENTION

In some embodiments a troffer light fixture comprises a LED assembly comprising at least one LED operable to emit light when energized through an electrical path. A housing supports the LED assembly where the housing comprises a first end cap permanently connected to the housing. A lens assembly comprises a lens that covers the LED assembly and a second end cap. The lens has a first end connected to the first end cap and a second end releasably connected to the second end cap. The second end cap is releasably connected to the housing such that the lens and the second end cap are releasably mounted to the housing as a unit.

The lens may comprise a first longitudinal edge and a second longitudinal edge where a first magnetic strip is attached to the first longitudinal edge and a second magnetic strip is attached to the second longitudinal edge. The first magnetic strip and the second magnetic strip may be magnetically adhered to the housing. The first magnetic strip and the second magnetic strip may extend uninterrupted for the length of the first longitudinal edge and the second longitudinal edge. The first magnetic strip and the second magnetic strip may each comprise a magnet and a reflective layer. The reflective layer may comprise a polyethylene foam. The second end cap may be releasably mounted to the housing by a pair of deformable, resilient first engagement members on one of the housing and the second end cap that releasably engages a second engagement member on the other one of the housing and the second end cap. The second engagement member may comprise a rigid member.

In some embodiments a troffer light fixture comprises a LED assembly comprising at least one LED operable to emit light when energized through an electrical path. A housing supports the LED assembly and comprises a first end cap permanently connected to the troffer. A lens assembly comprises a lens covering the LED assembly and a second end cap. The lens has a first end connected to the first end cap and a second end releasably connected to the second end cap. The second end cap is releasably connected to the housing such that the lens and the second end cap are releasably mounted to the housing as a unit. The lens comprises a first longitudinal edge and a second longitudinal edge where a first magnetic strip is attached to the first longitudinal edge and a second magnetic strip is attached to the second longitudinal edge.

The first magnetic strip and the second magnetic strip may be magnetically adhered to the housing. The first magnetic strip and the second magnetic strip may extend uninterrupted for the length of the first longitudinal edge and the second longitudinal edge. The first magnetic strip and the second magnetic strip may each comprise a magnet and a reflective layer. The reflective layer may comprise a polyethylene foam. The second end cap may be releasably mounted to the housing by a pair of deformable, resilient first engagement members on one of the housing and the second end cap that releasably engages a second engagement member on the other one of the housing and the second end cap. The second engagement member may be a rigid member.

In some embodiments a light fixture comprises a LED assembly comprising at least one LED operable to emit light when energized through an electrical path. A housing supporting the LED. A lens covering the at least one LED, the lens having a peripheral edge where a magnetic strip is attached to the peripheral edge to form a seal with the housing.

The magnetic strip may be magnetically adhered to the housing. The magnetic strip may extend substantially uninterrupted for the length of the peripheral edge. The magnetic strip may extend uninterrupted for the length of the peripheral edge. A mounting mechanism may attach the lens to the housing and the magnetic strip may extend uninterrupted for the length of the peripheral edge except where the mounting mechanism is located. The magnetic strip may comprise a magnet and a reflective layer. The reflective layer may comprise a polyethylene foam.

DETAILED DESCRIPTION OF EMBODIMENTS OF THE INVENTION

Figure 1A:
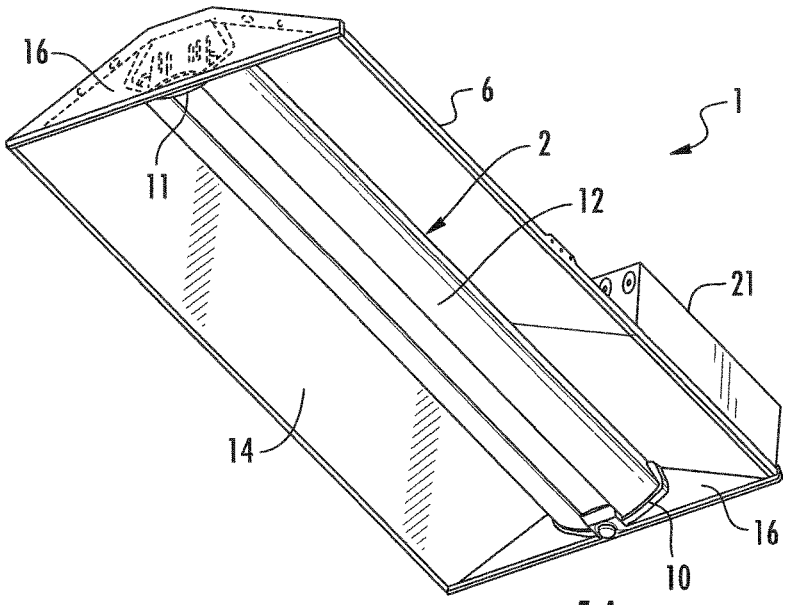
FIG. 1A is a perspective view of an embodiment of a lighting fixture.

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element such as a layer, region or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" or "top" or "bottom" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein.

Unless otherwise expressly stated, comparative, quantitative terms such as "less" and "greater", are intended to encompass the concept of equality. As an example, "less" can mean not only "less" in the strictest mathematical sense, but also, "less than or equal to."

The terms "LED" and "LED device" as used herein may refer to any solid-state light emitter. The terms "solid state light emitter" or "solid state emitter" may include a light emitting diode, laser diode, organic light emitting diode, and/or other semiconductor device which includes one or more semiconductor layers, which may include silicon, silicon carbide, gallium nitride and/or other semiconductor materials, a substrate which may include sapphire, silicon, silicon carbide and/or other microelectronic substrates, and one or more contact layers which may include metal and/or other conductive materials. A solid-state lighting device produces light (ultraviolet, visible, or infrared) by exciting electrons across the band gap between a conduction band and a valence band of a semiconductor active (light-emitting) layer, with the electron transition generating light at a wavelength that depends on the band gap. Thus, the color (wavelength) of the light emitted by a solid-state emitter depends on the materials of the active layers thereof. In various embodiments, solid-state light emitters may have peak wavelengths in the visible range and/or be used in combination with lumiphoric materials having peak wavelengths in the visible range. Multiple solid state light emitters and/or multiple lumiphoric materials (i.e., in combination with at least one solid state light emitter) may be used in a single device, such as to produce light perceived as white or near white in character. In certain embodiments, the aggregated output of multiple solid-state light emitters and/or lumiphoric materials may generate warm white light output having a color temperature range of from about 2200K to about 6000K.

Solid state light emitters may be used individually or in combination with one or more lumiphoric materials (e.g., phosphors, scintillators, lumiphoric inks) and/or optical elements to generate light at a peak wavelength, or of at least one desired perceived color (including combinations of colors that may be perceived as white). Inclusion of lumiphoric (also called 'luminescent') materials in lighting devices as described herein may be accomplished by direct coating on solid state light emitter, adding such materials to encapsulants, adding such materials to lenses, by embedding or dispersing such materials within lumiphor support elements, and/or coating such materials on lumiphor support elements. Other materials, such as light scattering elements (e.g., particles) and/or index matching materials, may be associated with a lumiphor, a lumiphor binding medium, or a lumiphor support element that may be spatially segregated from a solid state emitter.

Figure 1B:
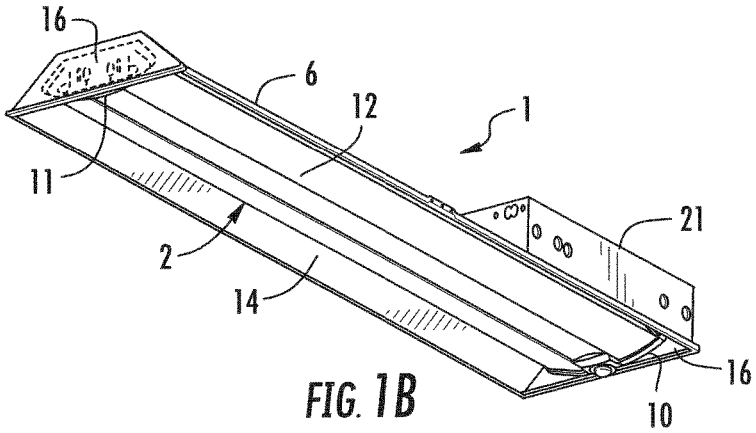
FIG. 1B is a perspective view of an embodiment of a lighting fixture similar to the lighting fixture of FIG. 1 having different dimensions.
Figure 1C:
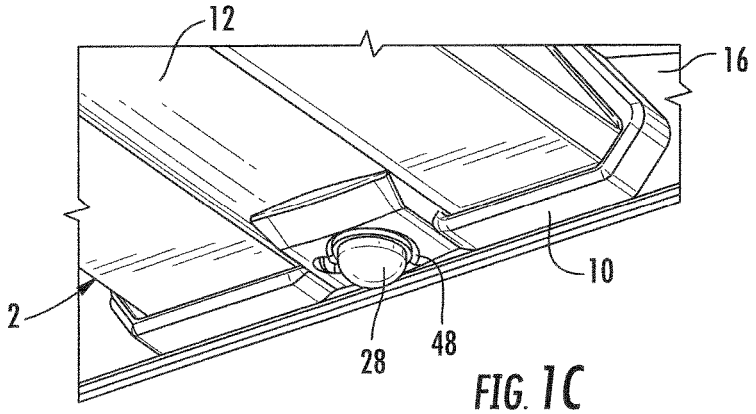
FIG. 1C is a detailed perspective view of the lighting fixture of FIG. 1.
Figure 8:
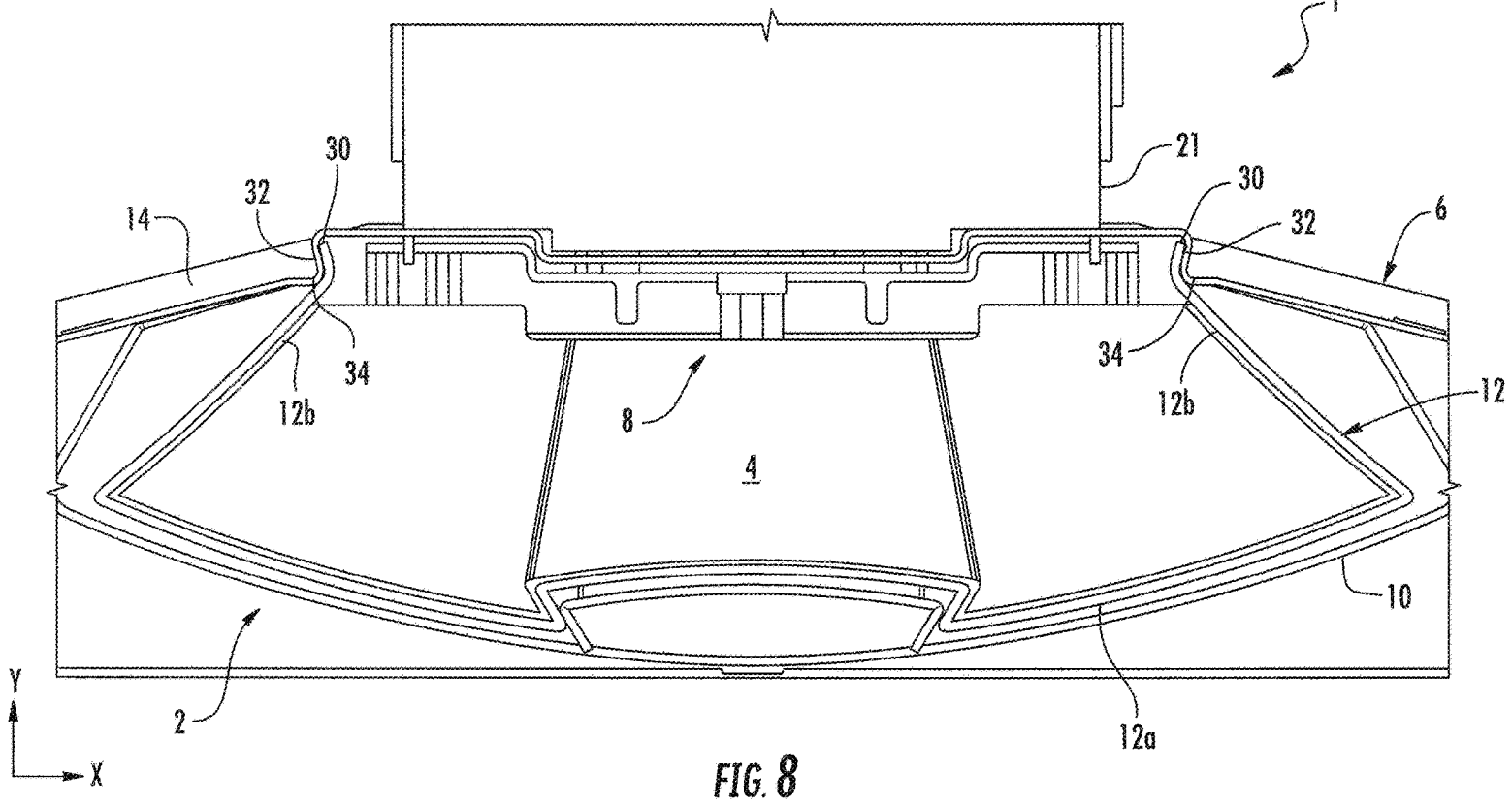
FIG. 8 is a partial section view showing a lens assembly mounted in a troffer housing.
Figure 9:
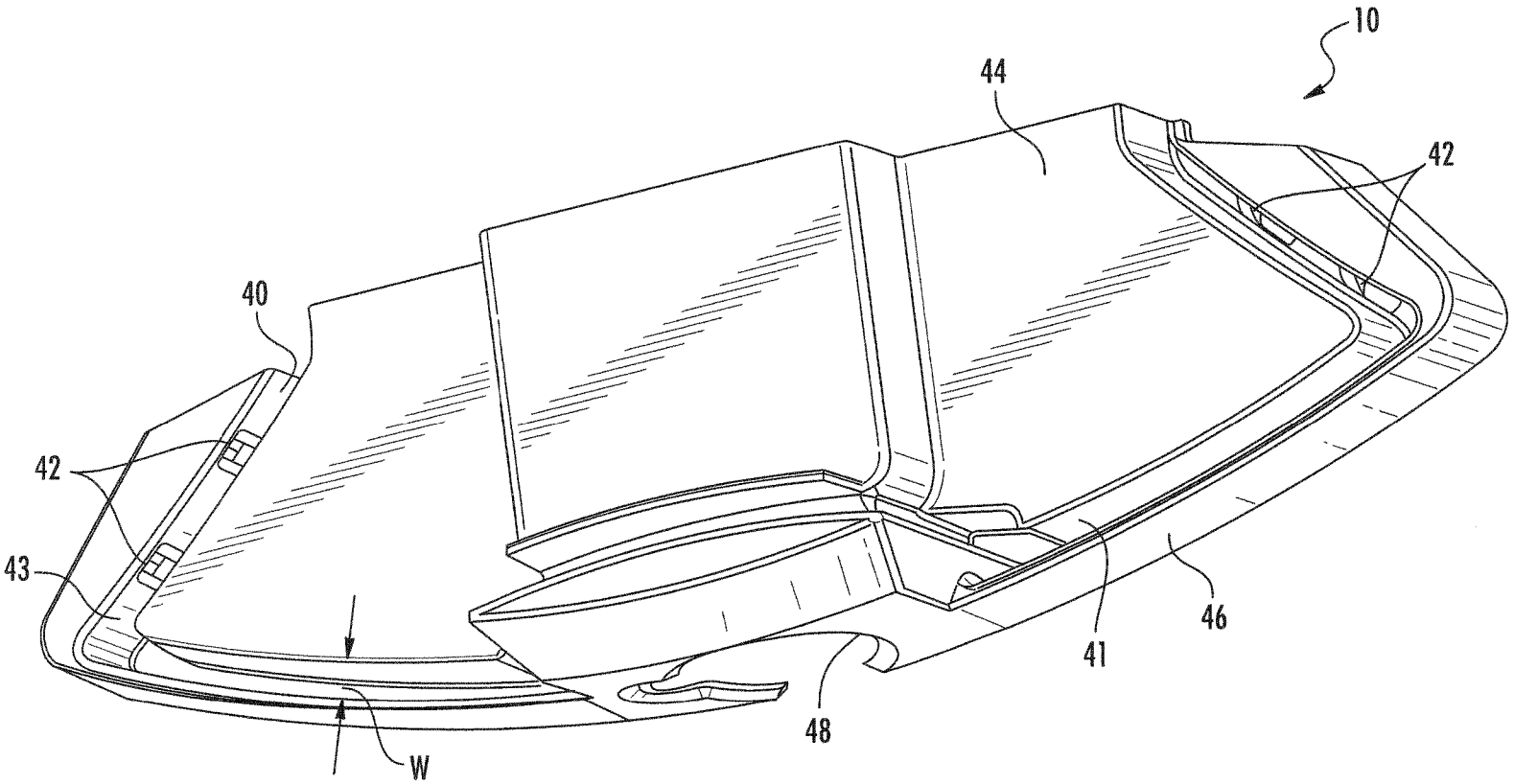
FIGS. 9 and 10 are perspective front views showing alternate embodiments of an end cap usable in the lens assembly.
Figure 10:
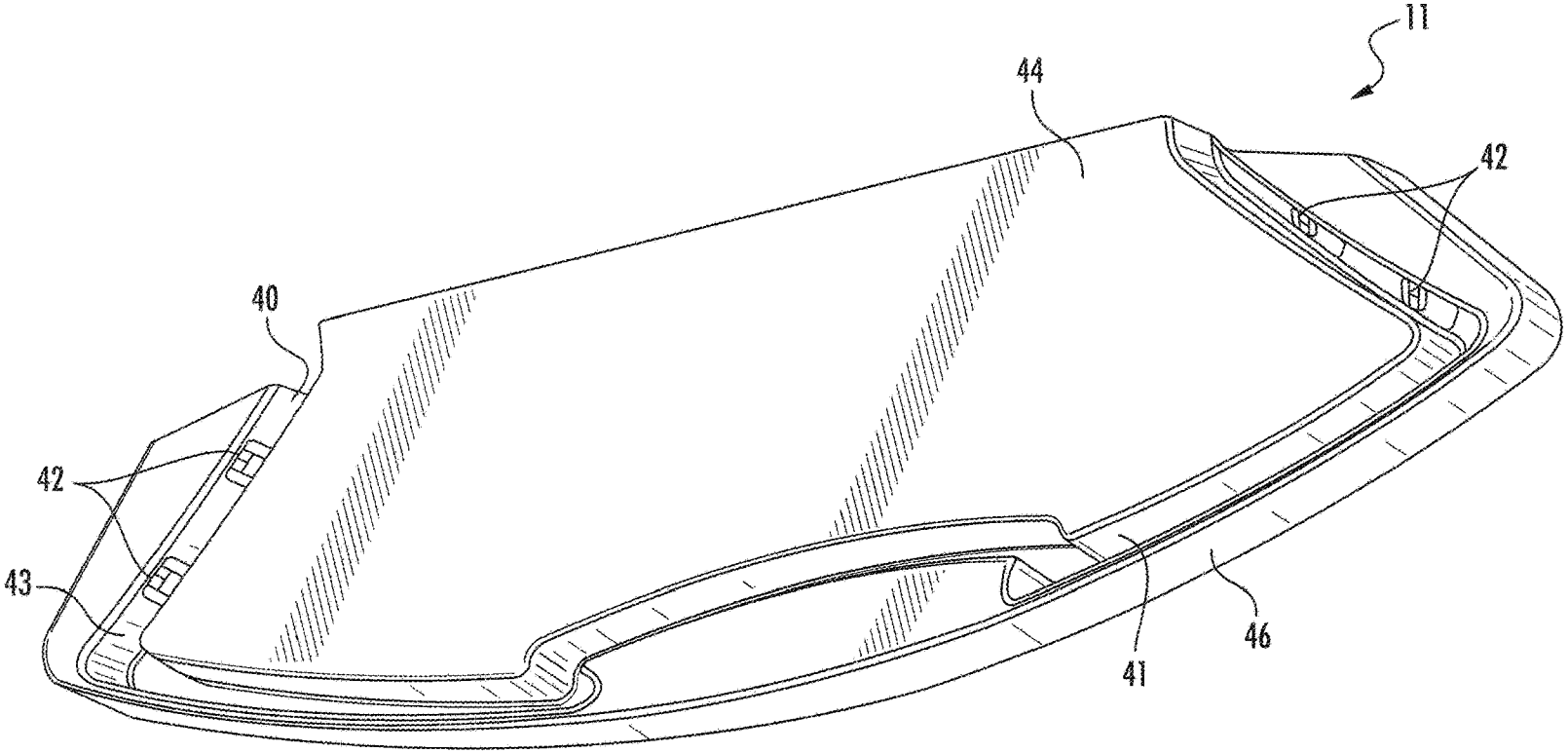

Embodiments of the present invention provide a troffer-style light fixture that is particularly well-suited for use with solid state light sources, such as LEDs. Referring to FIGS. 1A-1C the light fixture 1 comprises a troffer housing 6 that may be removably attached within a T grid, ceiling grid or other suitable support structure. The light fixture 1 is shown in FIGS. 1A and 1B in a typical orientation where the light is emitted in a generally downward direction; however, in use the light fixture may have other orientations. The light fixture 1 includes a lens assembly 2, which creates an interior space 4 (FIG. 8). The interior space 4 created by the lens assembly 2 houses LED assembly 8 and in some circumstances a light engine and/or additional electronics. Light assembly 2 comprises first end cap 10 and second end cap 11 that are disposed at either end of the lens 12 to close the interior space 4 and facilitate mounting of the lens assembly 2 in troffer housing 6. The troffer housing 6 may also support lamp electronics 21 such as a driver, power supply, control circuitry for Smart Cast technology or the like.

Figure 2:
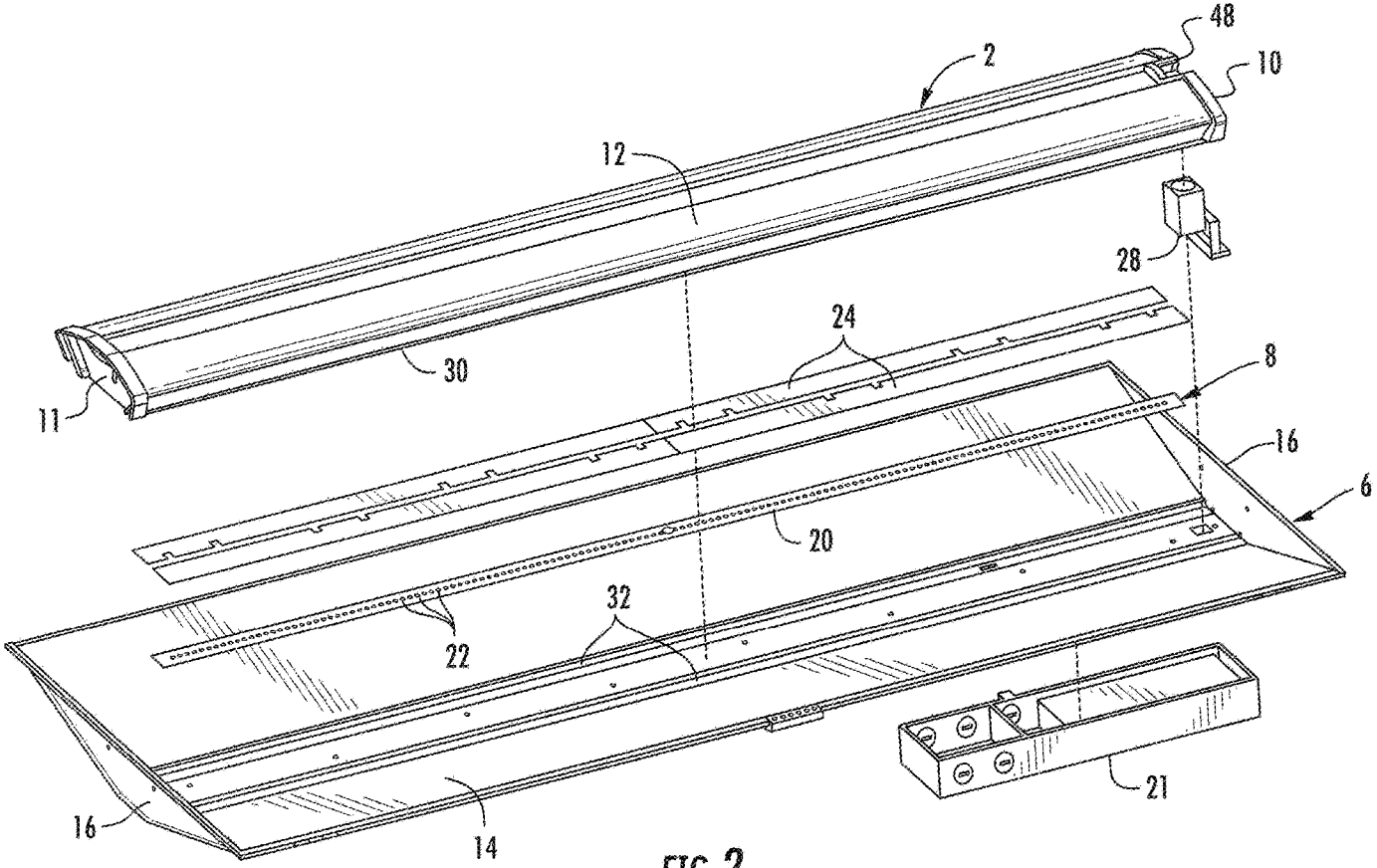
FIG. 2 is an exploded perspective view of the lighting fixture of FIG. 1.
Figure 3:
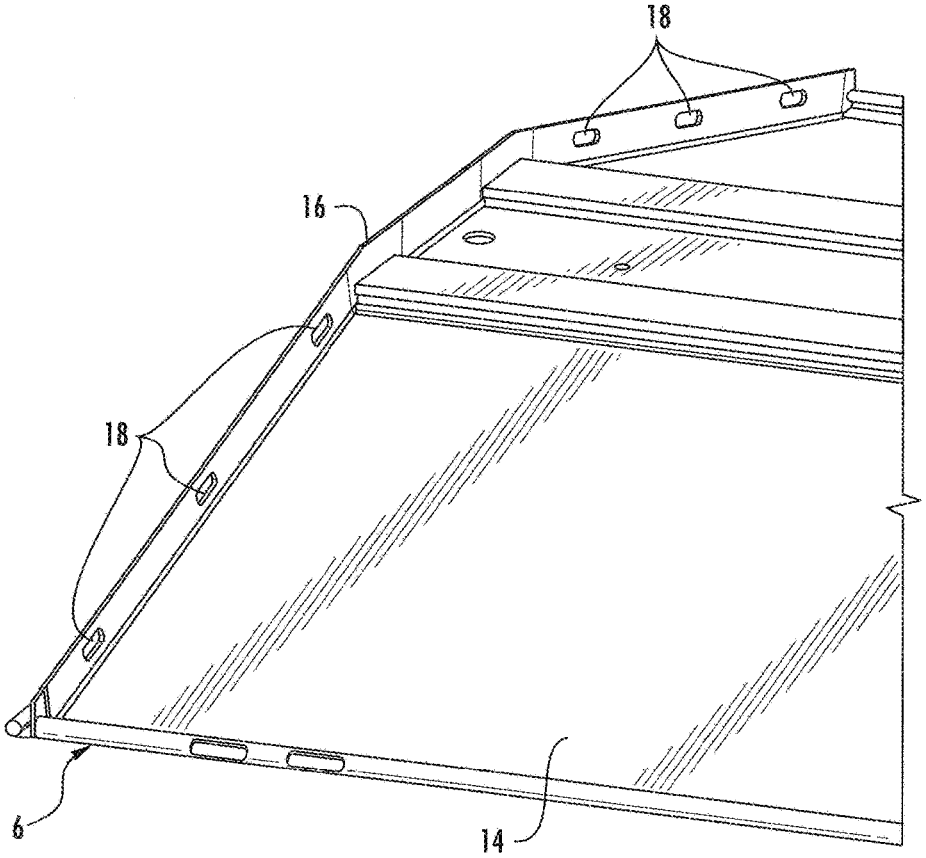
FIG. 3 is a partial perspective view of the lighting fixture of FIG. 1.

FIG. 2 is an exploded perspective view of light fixture 1 according to an embodiment of the present invention. The housing 6 comprises a back panel 14 having an end panel 16 secured to each end thereof. The end panels 16 and back panel 14 form a recessed pan style troffer housing defining an interior space for receiving the LED assembly 8 and the lens assembly 2. The end panels 16 and back panel 14 may be made of multiple sheet metal components secured together or the panels 14 and 16 and/or housing 6 may be made of a single piece of sheet metal formed into the desired shapes. In some embodiments, the back panel 14 may be multiple pieces. In one embodiment, the end panels 16 are separately secured to the back panel 14 using a clinching joint 18, as shown in FIG. 3, such as a TOX® joint. In other embodiments the connection between the end panels 16 and back panel 14 may be made by welding, screws, tabs and slots or the like. Use of a clinching joint 18 between the sheet metal panels provides a relatively low cost secure connection where the panels do not move relative to one another during use of the lamp.

The exposed surfaces of the back panel 14 and end panels 16 may be made of or coated with a reflective metal, plastic, or white material. One suitable metal material to be used for the reflective surfaces of the panels is aluminum (Al). The reflective surfaces of the panels may also include diffusing components if desired. The reflective surfaces of the panels may comprise many different materials. For many indoor lighting applications, it is desirable to present a uniform, soft light source without unpleasant glare, color striping, or hot spots. Thus, the panels may comprise a diffuse white reflector, such as a microcellular polyethylene terephthalate (MC-PET) material or a DuPont/WhiteOptics material, for example. Other white diffuse reflective materials can also be used. The reflectors may also be aluminum with a diffuse white coating.

Figure 4:
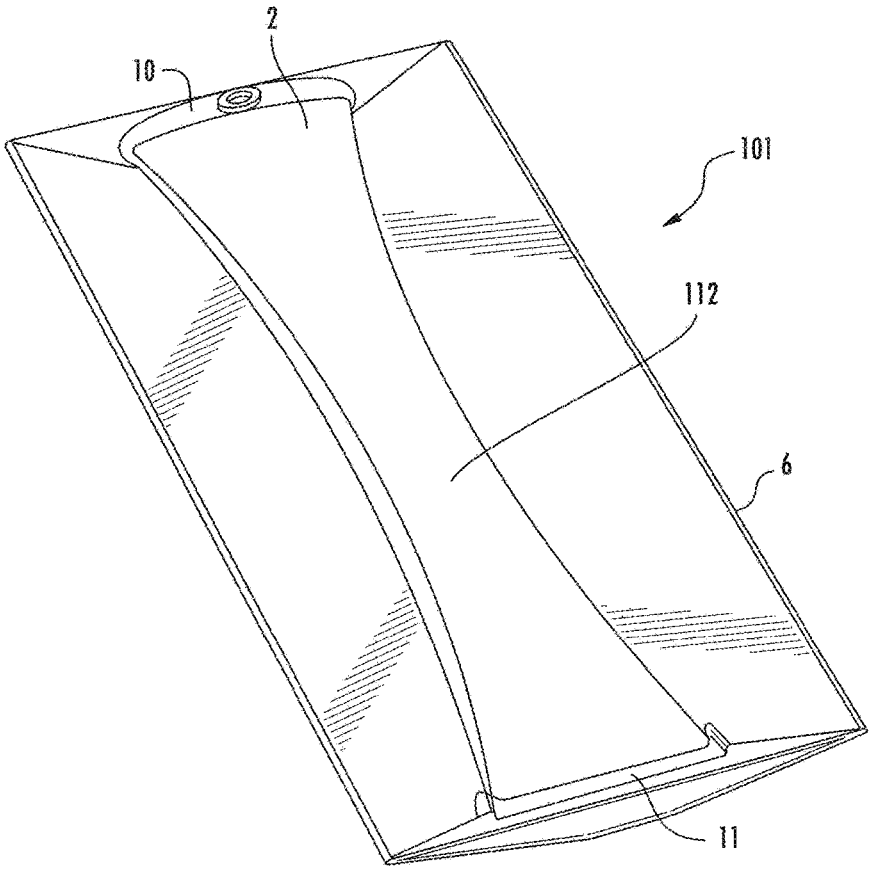
FIG. 4 is a perspective view of another embodiment of a lighting fixture.

The shape and optical properties of the lens 12 may be changed for aesthetic purposes and/or to change the emission pattern of the light emitted from the light fixture 1. For example FIG. 4 is a perspective view of a light fixture 101 according to another embodiment of the present disclosure. Light fixture 101 is similar to the light fixture 1 shown in FIG. 1, except that the lens 112 has an hourglass shape.

Many different troffer housings, reflector assemblies, LED assemblies and lens configurations may be used to achieve a particular output light profile. The light fixture may be provided in many sizes, including standard troffer fixture sizes, such as 2 feet by 4 feet (2'×4'), 1 foot by 4 feet (1'×4') or 2 feet by 2 feet (2'×2'), for example. However, it is understood that the elements of the light fixture may have different dimensions. Furthermore, it is understood that embodiments of the fixture can be customized to fit most any desired fixture dimension. The light fixture 1 may be mounted within a T grid by being placed on the supports of the T grid. In other embodiments, additional attachments, such as tethers, may be included to stabilize the fixture in case of earthquakes or other disturbances. The lighting schemes shown in the figures are meant to be exemplary. Thus, it is understood that many different dimensions of light emitter, lens, and reflector combinations can be used to generate a desired output and light color.

In this particular embodiment, a driver circuit is housed within a compartment 21. Electronic components within the compartments may be shielded and isolated. Various driver circuits may be used to power the light sources. Suitable circuits are compact enough to fit within the compartments, while still providing the power delivery and control capabilities necessary to drive high-voltage LEDs, for example. At the most basic level a driver circuit may comprise an AC to DC converter, a DC to DC converter, or both. In one embodiment, the driver circuit comprises an AC to DC converter and a DC to DC converter, both of which are located inside the compartment. In another embodiment, the AC to DC conversion is done remotely (i.e., outside the fixture), and the DC to DC conversion is done at the control circuit inside the compartment. In yet another embodiment, only AC to DC conversion is done at the control circuit within the compartment.

The LED assembly 8 comprises a LED board 20 with light emitters. The LED board 20 may be any appropriate board, such as a PCB or flexible circuit board. Light emitters may include any appropriate light emitters, such as LEDs 22. The LED board 20 can include the electronics and interconnections necessary to power the LEDs 22. In some embodiments the LED board 20 comprises a PCB with the LEDs 22 mounted and interconnected thereon. The LED assembly 8 may include clusters of discrete LEDs, with each LED within the cluster spaced a distance from the next LED, and each cluster spaced a distance from the next cluster. Some embodiments may use a series of clusters having two blue-shifted-yellow LEDs ("BSY") and a single red LED ("R"). Once properly mixed the resultant output light will have a "warm white" appearance. Other embodiments may use a series of clusters having three BSY LEDs and a single red LED. This scheme will also yield a warm white output when sufficiently mixed. Yet other embodiments may use a series of clusters having two BSY LEDs and two red LEDs. This scheme will also yield a warm white output when sufficiently mixed. In other embodiments separate blue-shifted-yellow LEDs and a green LED and/or blue-shifted-red LEDs and a green LED may be used. Details of suitable arrangements of the LEDs and lamp electronics for use in the light fixture 1 are disclosed in U.S. patent application Ser. No. 15/226,992, entitled "Solid State Light Fixtures Suitable for High Temperature Operation Having Separate Blue-Shifted-Yellow/Green and Blue-Shifted-Red Emitters" filed on Aug. 3, 2016 which is incorporated by reference herein in its entirety. In other embodiments, all similarly colored LEDs may be used where for example all warm white LEDs or all warm white LEDs may be used where all of the LEDs emit at a similar color point. In such an embodiment all of the LEDs are intended to emit at a similar targeted wavelength; however, in practice there may be some variation in the emitted color of each of the LEDs such that the LEDs may be selected such that light emitted by the LEDs is balanced such that the lamp emits light at the desired color point. In the embodiments disclosed herein a various combinations of LEDs of similar and different colors may be selected to achieve a desired color point. The interior space 4 defined by the lens 12 and the end caps 10, 11 mixes the light emitted by the LEDs to create an even, mixed light distribution that eliminates visible color spots and hot spots.

The LED board 20 may be aligned with the center of the housing 6 and lens 12. It is understood that nearly any length of LED board can be used. In some embodiments, any length of LED board can be built by combining multiple boards together to yield the desired length. The LEDs 22 can be mounted in a linear pattern or in clusters. Referring to FIG. 2, the light fixture 1 comprises an elongated rigid support structure 24 supporting an LED assembly 8. The support structure 24 may comprise a thermally conductive material such that it functions as a heat sink to dissipate heat from the LED assembly. Moreover the support structure may be thermally coupled to the housing such that heat from the LEDs is conducted to the housing via the support structure 24. The LED board 20 provides physical support for the LEDs 22 and may form part of the electrical path to the LEDs for delivering current to the LEDs. The LED board 20 may comprise a PCB, flex circuit or the like and may be connected to the support structure by any suitable connection mechanism including adhesive, screws, snap-fit connectors, board receptacles or the like. The term "electrical path" is used to refer to the entire electrical path to the LEDs 127, including an intervening power supply and all the electronics in the lamp disposed between the electrical connection that would otherwise provide power directly to the LEDs and the LEDs. Electrical conductors run between the LEDs and the source of electrical power, such as a buildings electrical grid, to provide critical current to the LEDs 127.

The electronic circuitry for powering the LEDs 22 such as the driver and power supply and other control circuitry may be contained as part of the light emitting assembly 8 or some or all of the lamp electronics may be supported separately from the light emitting assembly such as in housing 21 as shown in FIGS. 1A, 1B, 2 and 8.

Further, any of the embodiments disclosed herein may include one or more communication components 28 forming a part of the light control circuitry, such as an RF antenna that senses RF energy. The communication components may be included, for example, to allow the luminaire to communicate with other luminaires and/or with an external wireless controller. More generally, the control circuitry includes at least one of a network component, an RF component, a control component, and a sensor. The sensor, such as a knob-shaped sensor, may provide an indication of ambient lighting levels thereto and/or occupancy within the room or illuminated area. Such a sensor may be integrated into the light control circuitry. In various embodiments described herein various smart technologies may be incorporated in the lamps as described in the following United States patent applications "Solid State Lighting Switches and Fixtures Providing Selectively Linked Dimming and Color Control and Methods of Operating," application Ser. No. 13/295,609, filed Nov. 14, 2011, which is incorporated by reference herein in its entirety; "Master/Slave Arrangement for Lighting Fixture Modules," application Ser. No. 13/782,096, filed Mar. 1, 2013, which is incorporated by reference herein in its entirety; "Lighting Fixture for Automated Grouping," application Ser. No. 13/782,022, filed Mar. 1, 2013, which is incorporated by reference herein in its entirety; "Multi-Agent Intelligent Lighting System," application Ser. No. 13/782,040, filed Mar. 1, 2013, which is incorporated by reference herein in its entirety; "Routing Table Improvements for Wireless Lighting Networks," application Ser. No. 13/782,053, filed Mar. 1, 2013, which is incorporated by reference herein in its entirety; "Commissioning Device for Multi-Node Sensor and Control Networks," application Ser. No. 13/782,068, filed Mar. 1, 2013, which is incorporated by reference herein in its entirety; "Wireless Network Initialization for Lighting Systems," application Ser. No. 13/782,078, filed Mar. 1, 2013, which is incorporated by reference herein in its entirety; "Commissioning for a Lighting Network," application Ser. No. 13/782,131, filed Mar. 1, 2013, which is incorporated by reference herein in its entirety; "Ambient Light Monitoring in a Lighting Fixture," application Ser. No. 13/838,398, filed Mar. 15, 2013, which is incorporated by reference herein in its entirety; "System, Devices and Methods for Controlling One or More Lights," application Ser. No. 14/052,336, filed Oct. 10, 2013, which is incorporated by reference herein in its entirety; and "Enhanced Network Lighting," application Ser. No. 61/932,058, filed Jan. 27, 2014, which is incorporated by reference herein in its entirety. Additionally, any of the light fixtures described herein can include the smart lighting control technologies disclosed in U.S. Provisional Application Ser. No. 62/292,528, titled "Distributed Lighting Network", filed on Feb. 8, 2016 and assigned to the same assignee as the present application, the entirety of this application being incorporated by reference herein.

Figure 5:
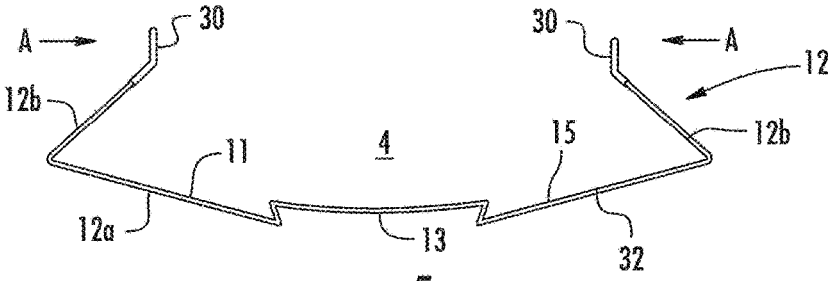
FIGS. 5, 6 and 7 are end views of alternative embodiments of a lens usable in the light fixture.
Figure 6:
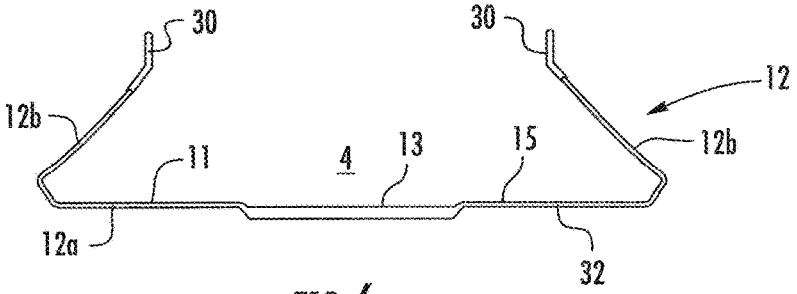
Figure 7:
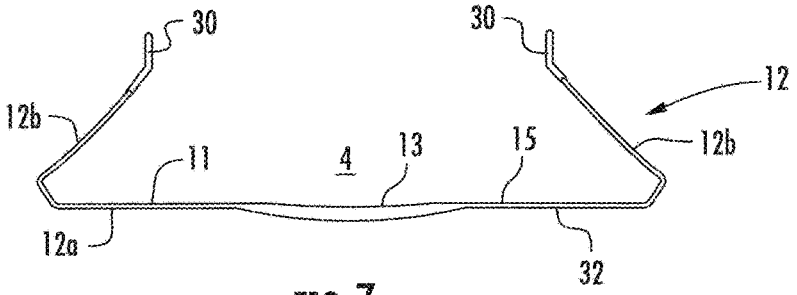

The lens 12 may be a one-piece member or it may be constructed of multiple pieces assembled to create the lens. The lens 12 may be made of plastic, such as extruded plastic. In one embodiment the entire lens 12 is light transmissive and diffusive. In other embodiments, the front portion 12*a* of the lens 102 may be clear or diffuse to allow to be emitted from the lens while the side walls of the lens 12*b* or portions of the side walls such as the surfaces adjacent to the LEDs 22 may be reflective. For example, this area may be coated with a white reflective material. The front portion 12*a* of the lens 102 may be uniform or may have different features and diffusion levels. In yet other embodiments, a portion of the lens may be more diffuse than the remainder of the lens. FIGS. 5-7 show various profiles for the lens 112. For example, the convex curved lens of FIG. 5 may provide a wider emission angle than the flat lenses of FIGS. 6 and 7.

The front portion 12*a* of the lens has three distinct areas 11, 13 and 15 that extend for the length of the lens. The three longitudinal areas break the light up into three parts, a central zone emitted by area 13 and two side zones emitted by areas 11 and 15. The central zone 13 is the most obvious illuminated zone with the LEDs disposed directly behind this area. The two side zones 11, 15 offer similar light but with less glare. The channel that defines the central area has a functional purpose in that optical films with any type of pattern or diffusion can be inserted in the channel to customize the look of the fixture as well as offer functional benefits such as greater diffusion, some light bending, and customized patterns. The center recess shown in FIG. 5 also decreases the visual appearance of LED pixilation.

In one embodiment the lens 12 has a front portion 12*a* connected to two side walls 12*b* to define a generally U-shaped profile having an open top end defined by a pair of longitudinal edges 30. The longitudinal edges 30 extend for the length of the lens and extend generally parallel to the LED assembly 8 between the end caps 10, 11. The longitudinal edges 30 define opposed flared flanges that engage mating slots 32 formed in the back panel 14 of the housing 6. The opposite ends of the lens 12 define side edges 32 having a shape as shown, for example, in FIGS. 5 through 7. The side edges 32 engage end caps 10, 11 such that the end caps 10, 11 and lens 12 are removably mounted to the housing 6 as a unit. The lens 12 may be extruded of resilient material such as plastic such that the longitudinal edges 30 of the lens 12 may be compressed toward one another upon the application of a force in the direction of arrows A (FIG. 5).

Referring to FIGS. 9-12 the end caps 10 and 11 are substantially identical except that end cap 10 is slightly wider and includes an aperture 48 in order to accommodate the communication components 28 such as a sensor, RF components or the like if the light fixture is used with Smart Cast technology as previously described. In some embodiments, one of each of end caps 10 and 11 are used; however, in some embodiments to end caps 10 may be used or two end caps 11 may be used depending upon the communication components 28 used. The end caps may be provided in various dimensions and styles suitable for the aesthetics of the light fixture.

Each end cap 10, 11 comprises a wall 44 that forms the end of the enclosure defining space 4. The wall 44 terminates in one side wall 41 of slot 40 and the opposite side wall 43 of the slot 40 is formed by a flange 46 spaced from the end wall 44. The slot 40 is configured to receive one side edge 32 of the lens 12 such that one end cap 10, 11 is mounted to either end of the lens 12. The slot 40 and lens 12 have mating complex shapes such that the end cap 10 is substantially prevented from moving relative to the lens 12 in the x-y plane. The width W of the slot 40 may be greater than the thickness of the lens 12 to accommodate manufacturing tolerances in the extruded lens. To retain the lens 12 in the slot 40 retaining members may be provided. In one embodiment the retaining members comprise resilient members 42 that extend from one of the side walls 41, 43 of the slot 40 such that when the lens 12 is inserted into the slot 40 the resilient members 42 are deformed into engagement with the lens to create a force on the lens 12 sufficient to retain the end caps 10, 11 on the lens 12. The end caps 10, 11 may be formed of plastic and the resilient members 42 may be formed as one piece with the end caps where the members extend from one side wall of the slot across the slot. Where manufacturing tolerances are tightly controlled, the lens 12 may be press fit into the mating slot 40 and the resilient members 42 may be eliminated. In other embodiments the retaining members may comprise separate clips, fasteners, tabs and slots, snap-fit connectors or the like.

Figure 11:
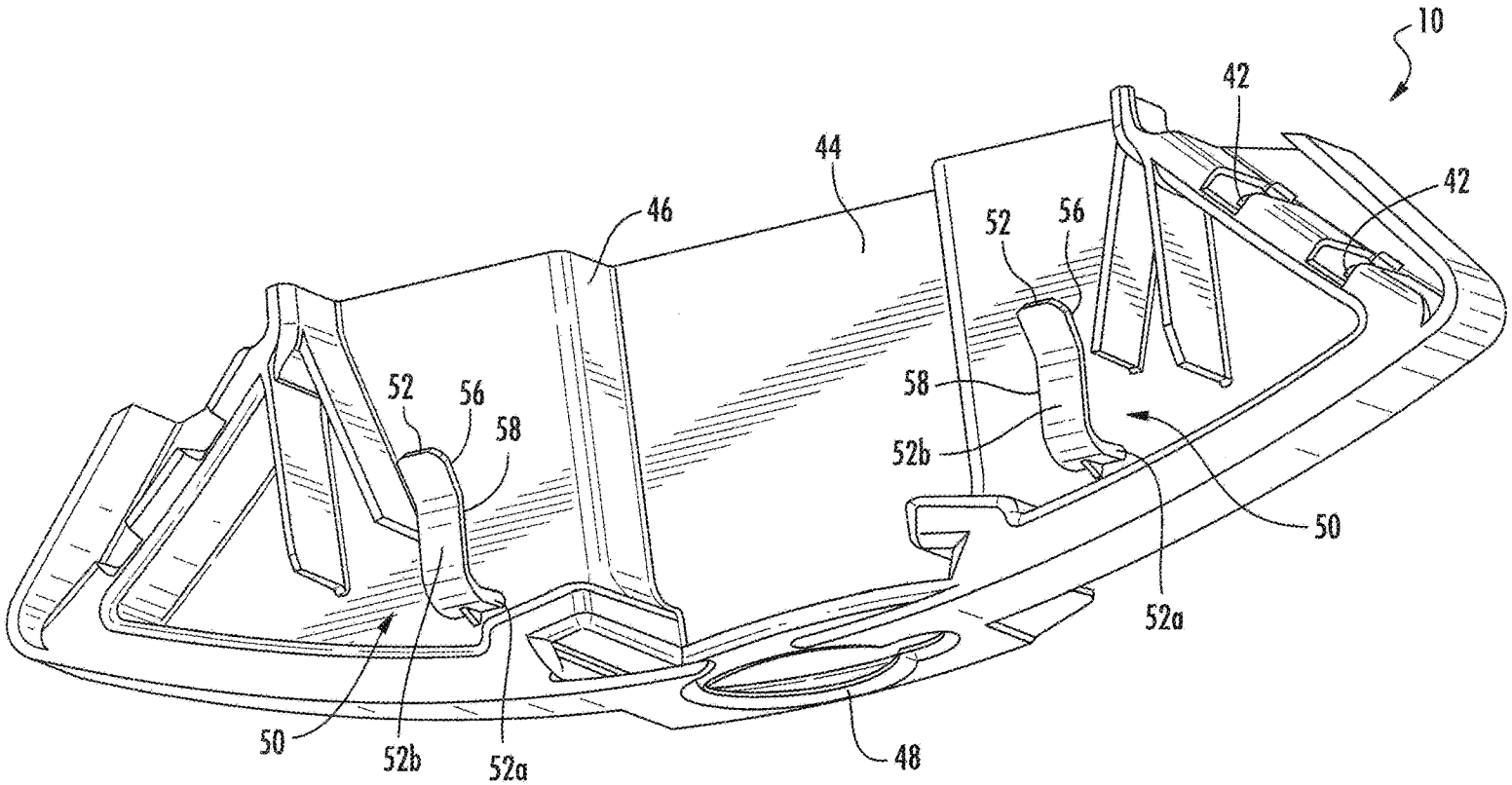
FIGS. 11 and 12 are perspective back views of the end caps of FIGS. 9 and 10, respectively.
Figure 12:
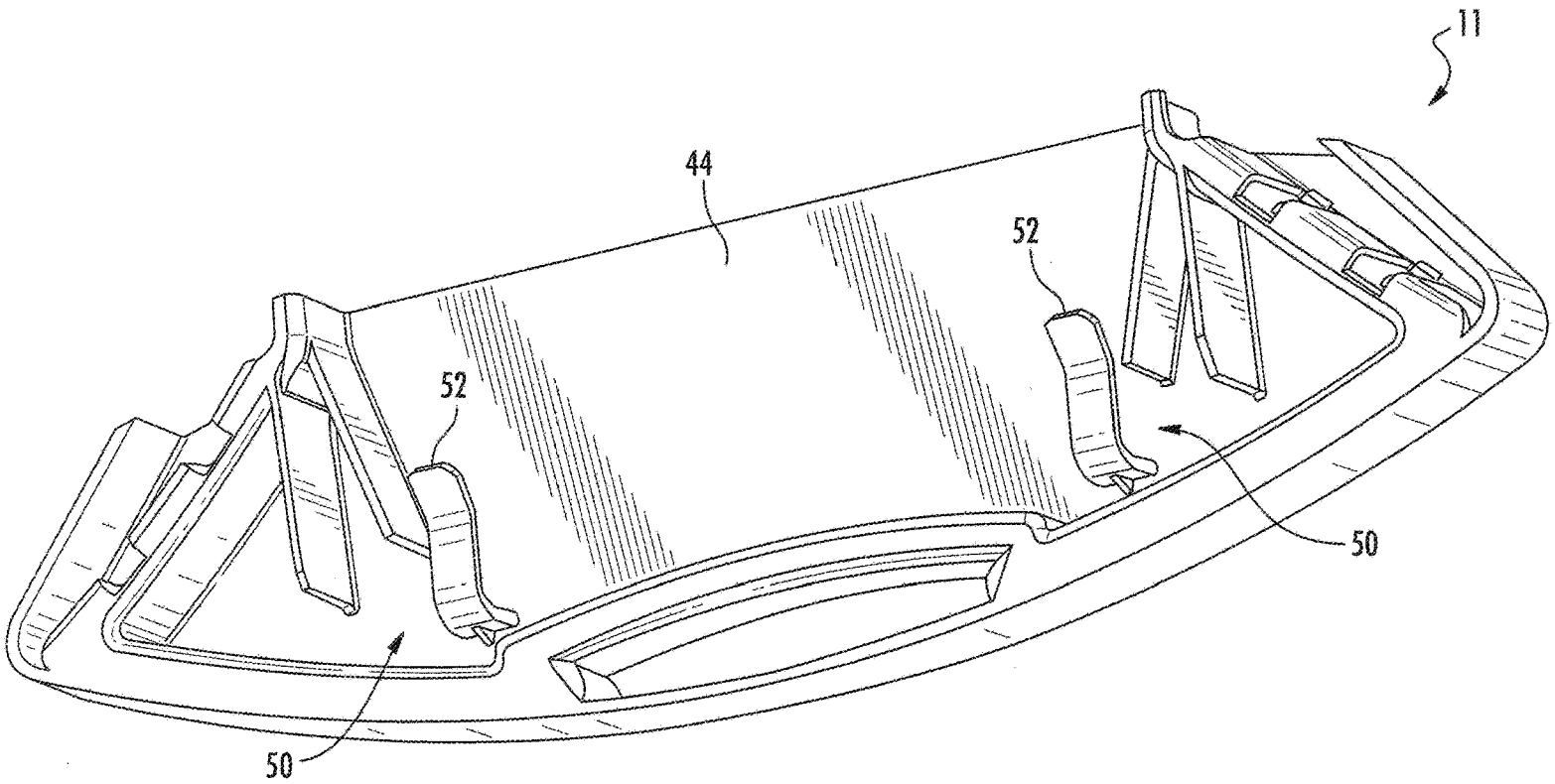
Figure 13:
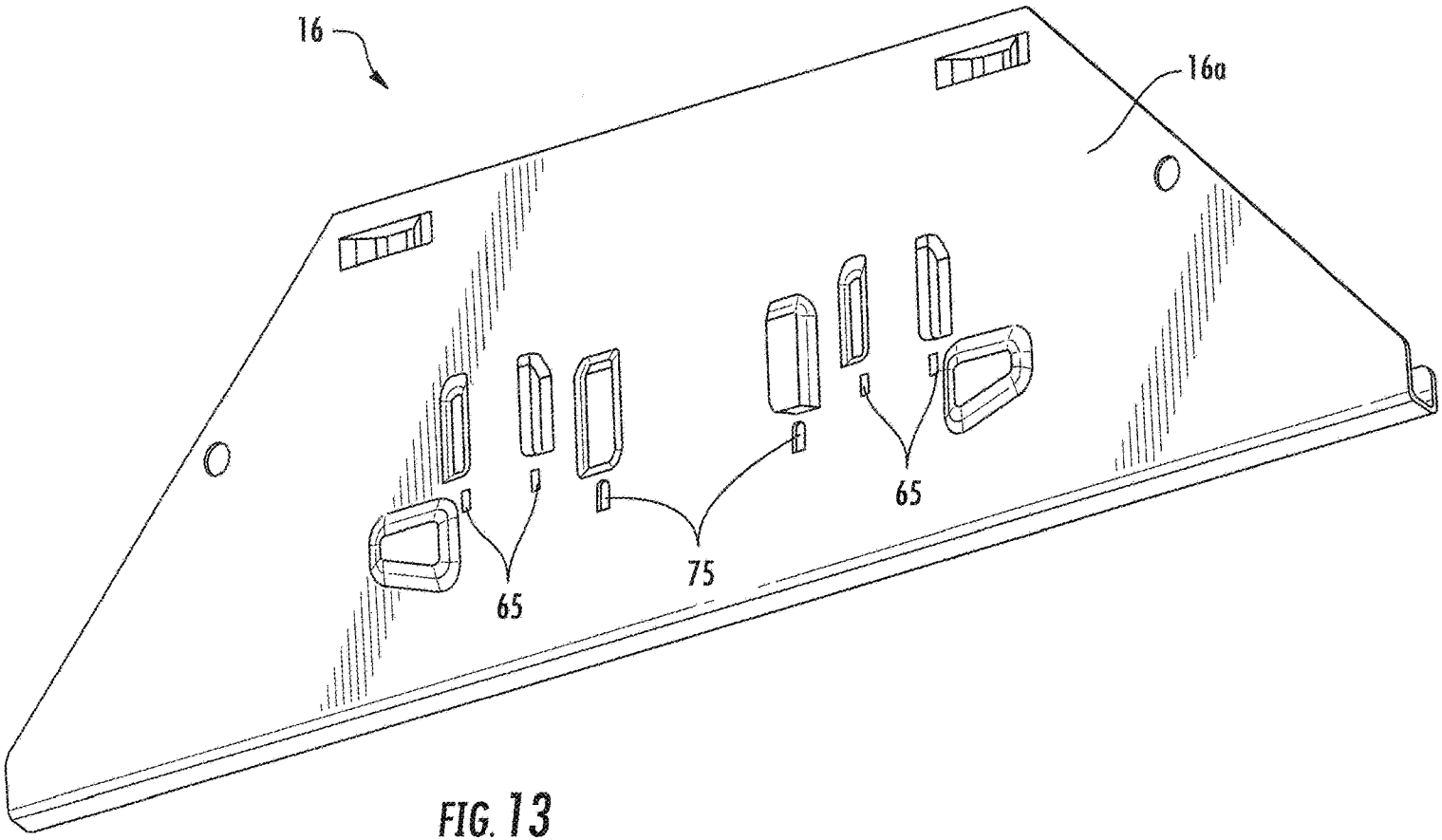
FIG. 13 is a perspective view of an end panel of the troffer housing.
Figure 14:
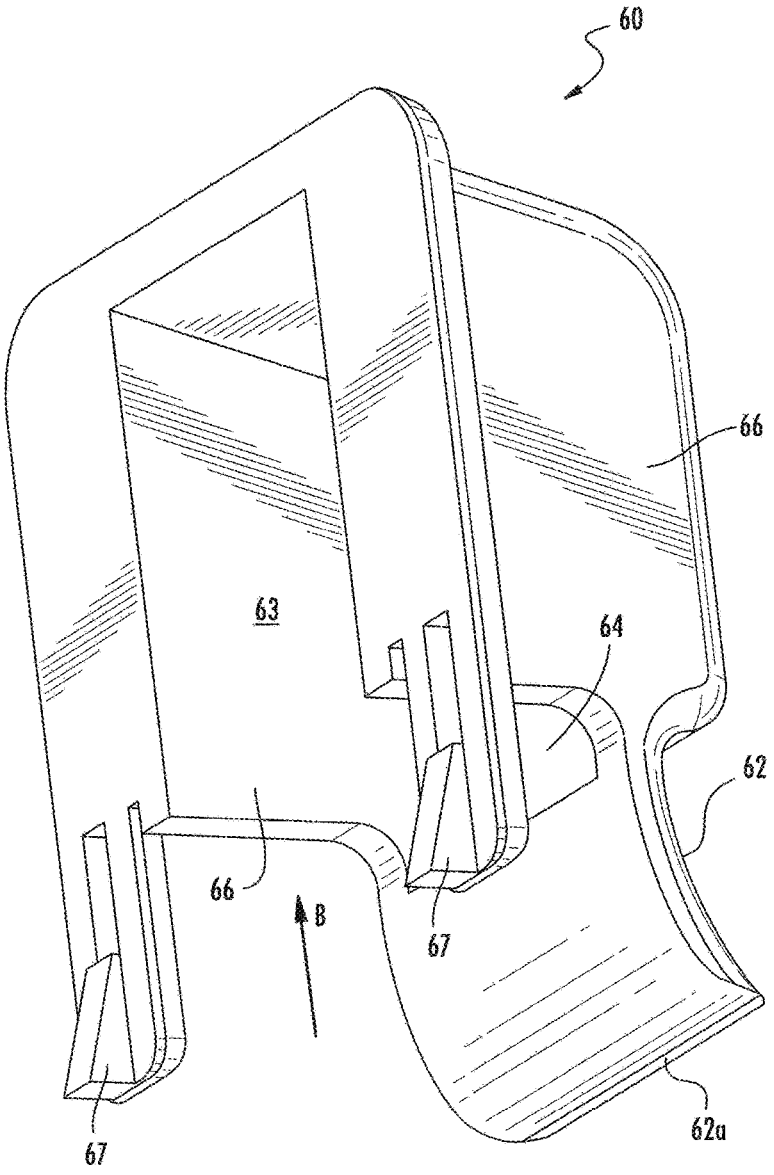
FIG. 14 is a perspective view of an engagement member that is mounted to the end panel.

Referring to FIGS. 11 and 12 the opposite side of wall 44 includes first mounting structures 50 for mounting the end caps 10 to the housing 6. Each mounting structure 50 comprises an upwardly extending deformable, resilient engagement member 52 extending from the end wall 44. The engagement member 52 has a first leg 52*a* that extends substantially perpendicularly from the wall 44 and a second leg 52*b* that extends from the first leg generally parallel to the wall 44 and terminates in a free end. The engagement members 52 may be formed as one piece with the end caps 10, 11 where the end caps and engagement members may be molded of plastic as a one-piece member. In other embodiments the engagement members 52 may be separate components from the end caps and may be secured thereto by any suitable connection mechanism. In the illustrated embodiment two engagement members 52 are provided on each end cap 10, 11 spaced laterally from one another on the wall 44 although a greater or fewer number of engagement members may be used. The second leg 52*b* includes a flared portion 56 that angles away from the wall 44 to facilitate the engagement with a mating second engagement member on the end panel 16 of housing 6. A protrusion 58 may be provided on the interior face of second leg 52*b*.

The first mounting structures 50 on the end caps 10 engage mating second mounting structures 60 formed on the exposed surfaces 16*a* of the end panels 16. Referring to FIGS. 13-18 the second mounting structures 60 comprise a relatively rigid engagement member 62 supported in a spaced relationship relative to the end panel 16. The second engagement member 62 is supported on the end panel 16 by a pair if sidewalls 66 that are joined to the opposite sides of the engagement member 62 to create a receptacle 63 for receiving the first engagement member 52. Configuring that second mounting structure 60 as a receptacle provides proper alignment between the lens assembly 12 and the troffer housing 6 during installation of the lens assembly 12. Other alignment mechanisms may also be used. The second mounting structures 60 are secured to the end panels 16 such that the receptacles 63 faces the end panel and the second engagement members 62 are spaced from the end panels 16. In one embodiment pairs of slots 65 are provided in the end panels 16 that receive tabs 67 formed on the second mounting structures 60 to position the second mounting structures 60 to receive the first mounting structures 50. The second mounting structures 60 may be secured to the end panels 16 using any suitable connection mechanism such as welding, crimping, separate fasteners or the like.

Figure 15:
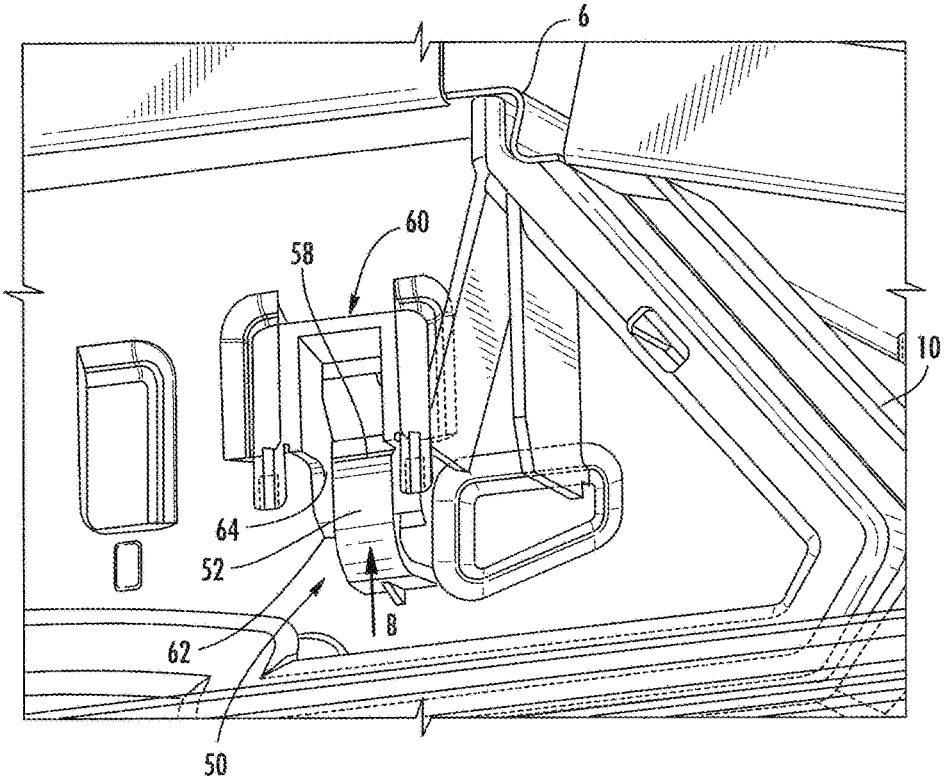
FIG. 15 is a perspective view showing the engagement of one engagement member on the troffer housing with one engagement member on the end cap.
Figure 16:
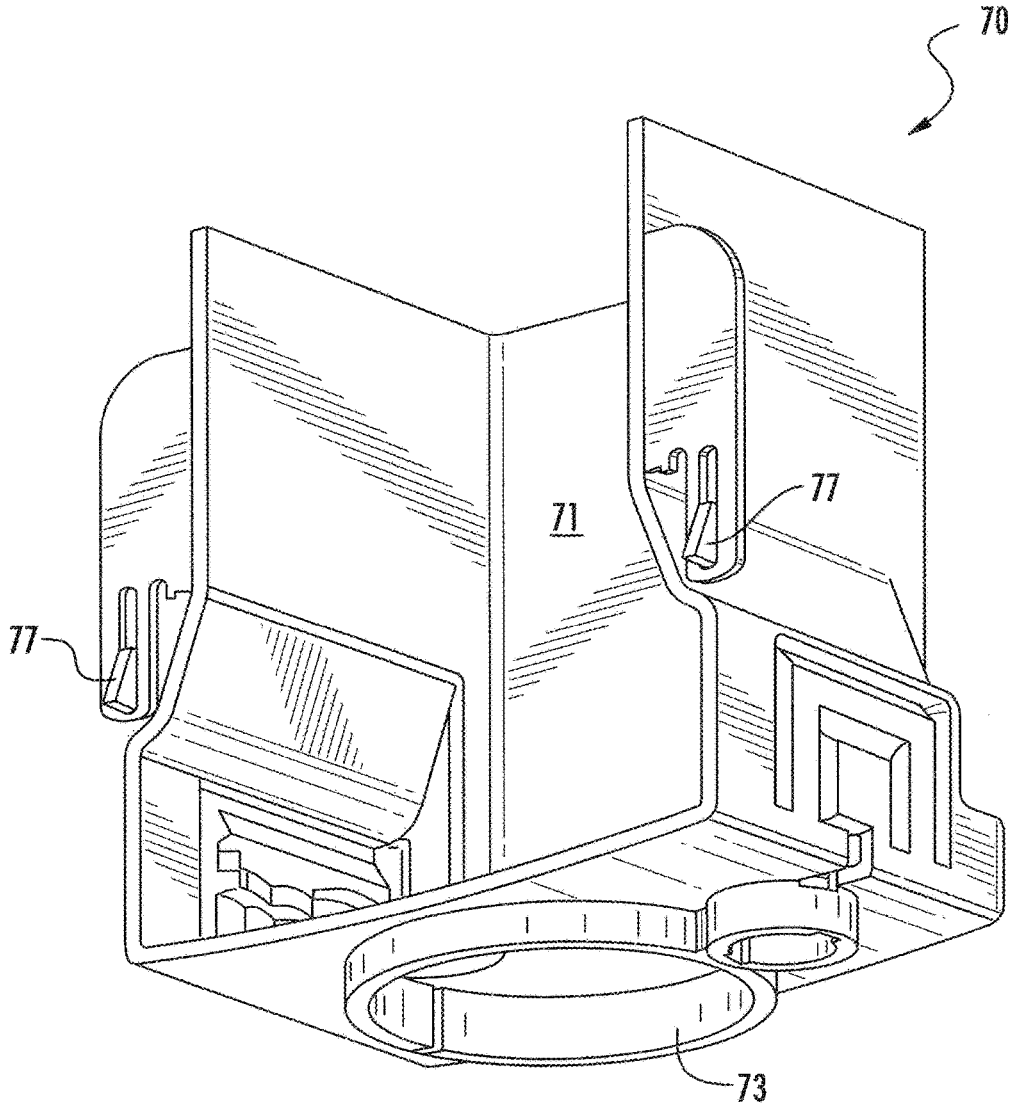
FIG. 16 is a perspective view of an electronics housing that is mounted to the end panel.
Figure 17:
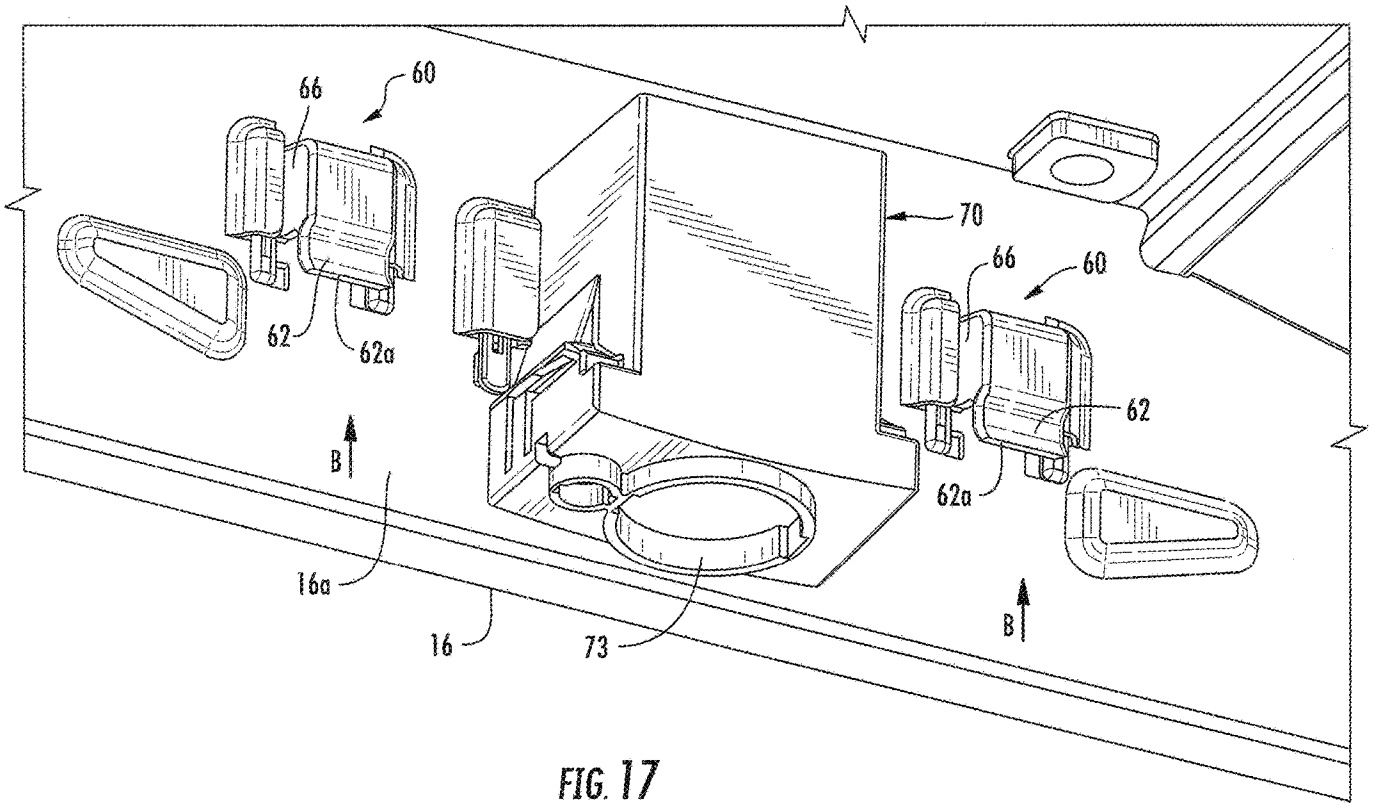
FIGS. 17 and 18 are detailed perspective views showing the engagement members and electronics housing mounted to the end panel.
Figure 18:
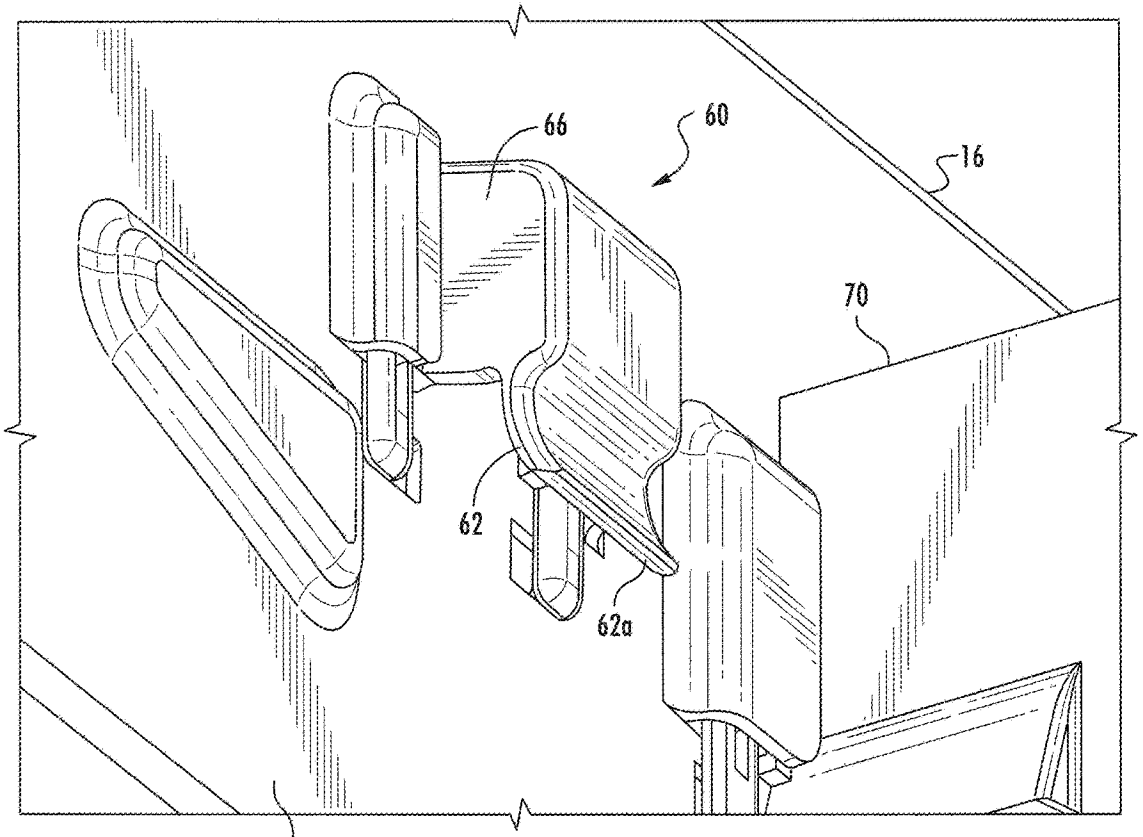
Figure 19:
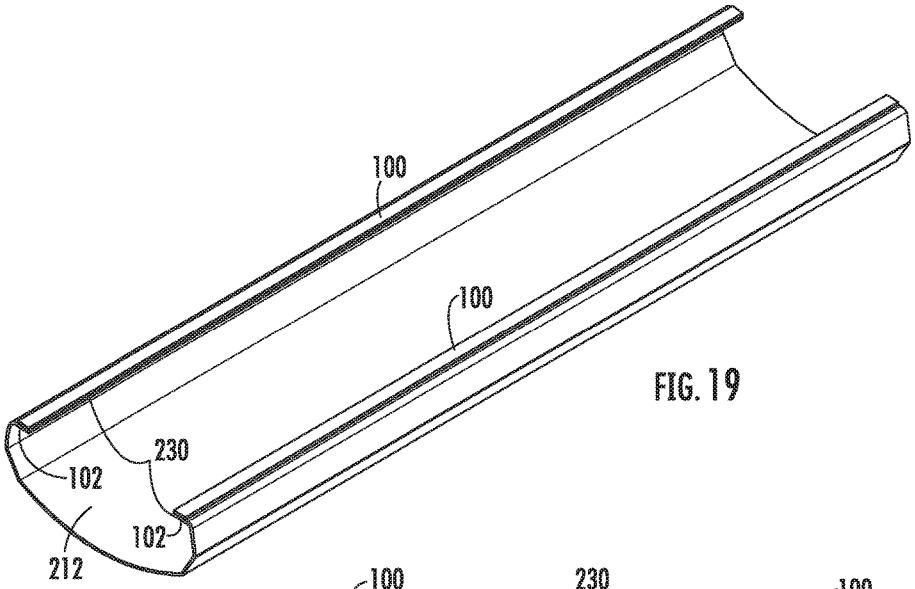
FIG. 19 is a perspective view of an alternate embodiment of the lens usable in the lens assembly of the invention.
Figure 20:
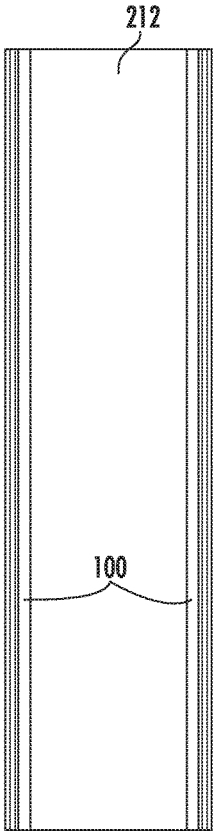
FIG. 20 is a top view of the lens of FIG. 19.
Figure 21:
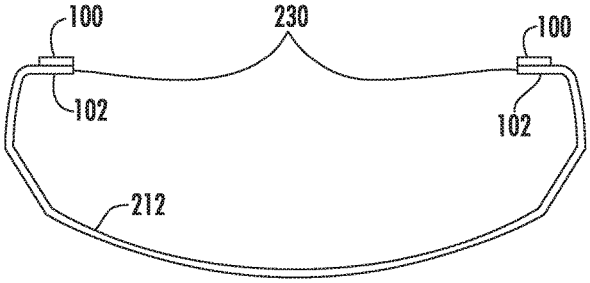
FIG. 21 is an end view of the lens of FIG. 19.
Figure 22:
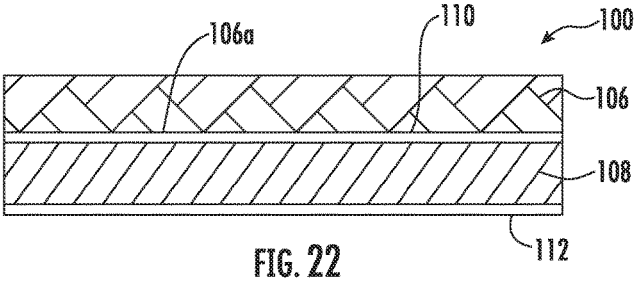
FIG. 22 is a section view of the magnetic strip of the embodiment of FIG. 19.

The rigid engagement member 62 has a flared free end 62*a* and is angled general toward panel 16 from its free end 62*a* and is configured to be engaged by the first engagement member 52 when the lens assembly 12 is mounted in the troffer housing 6. The engagement member 62 is disposed at an angle relative to the insertion direction B such that when the first engagement member 52 contacts the engagement member 62 it is deformed by the engagement member 62 as the lens assembly is moved linearly in the insertion direction B. Specifically the first engagement member 52 is flexed toward the surface 16*a* of end panel 16 to create a holding force between the first engagement member 52 and the second engagement member 62. The rigid engagement member 62 defines a lip or ledge 64 where, as the protrusion 58 on the resilient member 52 member passes the lip 64, the first engagement member 50 moves resiliently toward the undeformed state (away from the surface 16*a* of end panel 16) such that the protrusion 58 on the resilient engagement member 52 engages the lip or ledge 64 on the second engagement member 62. The engagement member 52 is resiliently deformed in this position such that it continues to exert a holding force on the engagement member 62 as shown in FIG. 15. The holding force is created by the friction force between the first engagement member 52 and the second engagement member 62 as well as by the mechanical engagement between the protrusion 58 on the first engagement member and the lip 64 on the second engagement member. Both forces are generated by the resilient deformation of the first engagement member into engagement with the second engagement member. While in the illustrated embodiment the first engagement member 52 on the end caps 10 is resilient and the second engagement member 62 on the troffer housing 6 is substantially rigid, the members may be reversed such that the first engagement member on the end caps 10 is rigid and the second engagement member on the troffer housing 6 is resilient and deformable. Moreover, both the first and second engagement members may be resiliently deformable.

The force created between the first and second engagement members is sufficient to hold the lens assembly 2 in the housing 6; however, the holding force is low enough that a user may remove the lens assembly 2 from the housing 6 by pulling the lens assembly downwardly in a direction opposite to the insertion direction B. Thus, the lens assembly 2 including the lens 12 and end caps 10 may be mounted in the housing by moving the lens assembly 2 linearly in a first insertion direction relative to the housing and engaging the first engagement members 52 with the second engagement members 62 and the lens assembly 2 may be easily removed from the housing 6 by moving the lens assembly in a second linear direction opposite to the insertion direction and disengaging the first engagement members from the second engagement members. To install and remove the lens assembly the lens assembly is only moved in a simple linear movement toward and away from the housing thereby simplifying the simultaneous installation and/or removal of the lens and end caps as a unit in a single operation.

During installation of the lens assembly 2 in the troffer housing 6, as the first engagement members 52 are engaged with the second engagement members 62, the longitudinal edges 30 of the lens are inserted into the slots or recesses 32 in the troffer housing 6 such that two longitudinal edges 30 of the lens 12 are positioned inside of the longitudinal edges 34 of the slots or recesses 32 along substantially the entire lengths thereof. The side walls of the lens 12 are slightly deformed inwardly as the lens is inserted in the housing to create a seal between the side walls of the lens and the longitudinal edges 34. The lens 12 is made of a resilient plastic material such that when the compressive force is released the sidewalls of the lens will tend to move away from one another to create the seal. The seal provides a clean line between the edges 34 of the housing and the lens 12 that is not affected by variations in the planarity of the lens resulting from manufacturing tolerances. The seal inhibits bugs or debris from entering the lens. The longitudinal edges 34 may be formed as rounded camming surfaces that deform the side walls 12*a* of the lens as the lens assembly 2 is mounted in housing 6 and/or the side walls of the lens may be compressed by the user as the lens assembly is installed in the housing 6 or both. As shown in FIG. 8 the edges 30 may be flared outwardly, away from one another, and the slots 34 are also flared outwardly such that the engagement of the edges 30 with slots 34 assists in retaining the lens assembly 2 in the housing 6. Flaring the edges 30 and slots 34 create a force that resists the force of gravity on the lens assembly.

Figure 27:
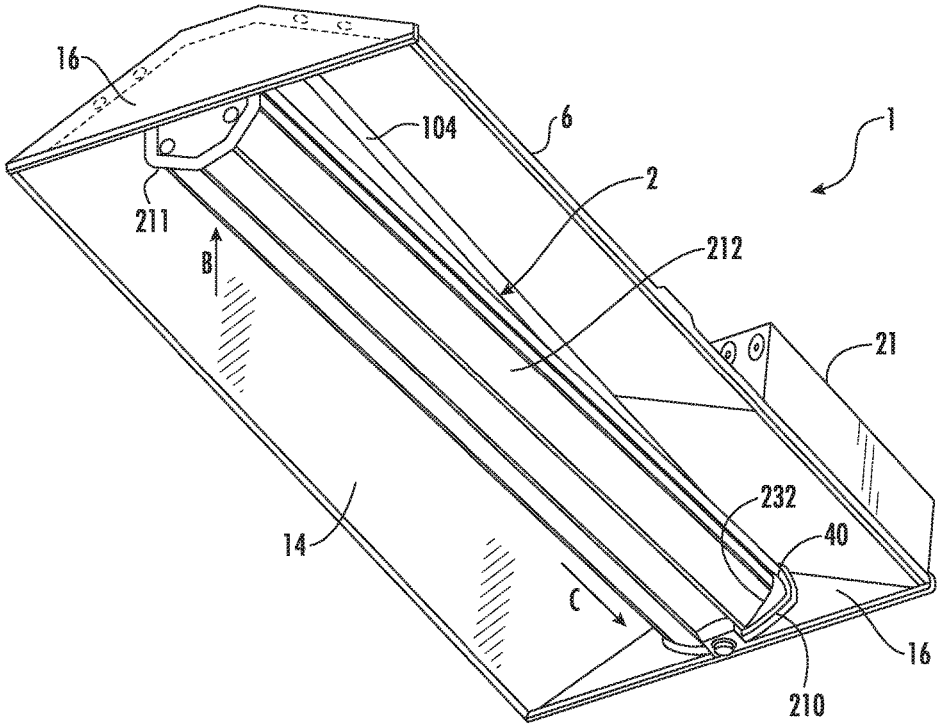
FIG. 27 shows an alternate embodiment of the lens assembly of the invention in a partially installed position in the troffer housing.
Figure 28:
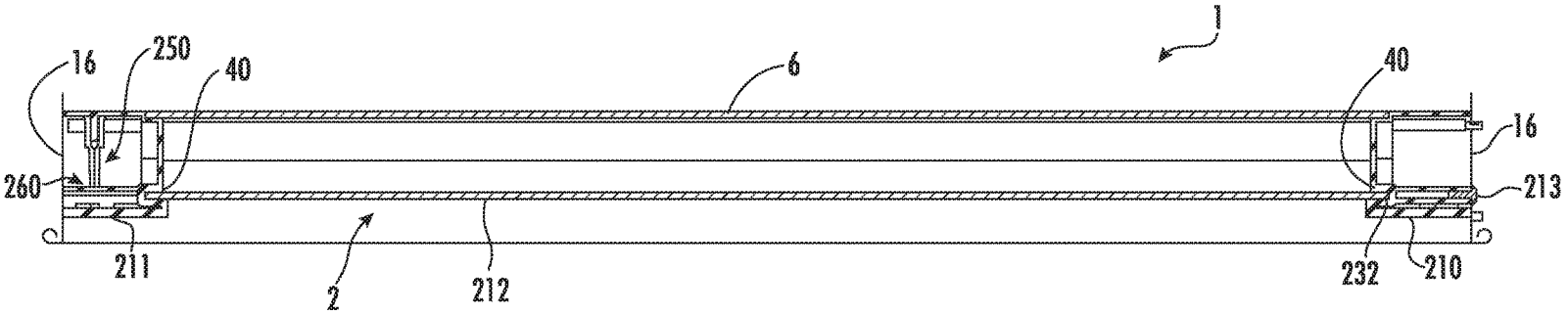
FIG. 28 is a section view showing the lens assembly of FIG. 27 mounted in a troffer housing.

Referring to FIGS. 27 and 28 in some embodiments, one of the end caps, for example end cap 211, may be removable with the lens 212 and the other one of the end caps, for example end cap 210, may be permanently fixed to the troffer housing 6. In such an embodiment the fixed end cap 210 may be secured to the troffer housing 6 by any suitable connection mechanism 213 such as fasteners, weld, adhesive, rivets, crimping, snap-fit or the like. As used herein the terms "fixed" and "removable" refer to the function of the end caps during normal installation and maintenance procedures to allow access to the interior of the lens assembly 2. The fixed end cap 210 may be secured to the troffer housing by a connection mechanism that may allow the removal of the end cap 210 under some circumstances but that is not intended to be removed during normal installation and maintenance of the light fixture. For example, if threaded fasteners are used to secure the fixed end cap 210 to the troffer housing 6, the fasteners may be removable under certain conditions; however, the fixed end cap is not intended to be removed during normal installation and maintenance of the light fixture such that the connection mechanism may also comprise a device or mechanism such as adhesive, weld or the like that may only allow removal of the fixed end cap from the troffer housing by dismantling, damaging or destruction of the end cap and/or troffer housing. Conversely the removable end cap 211 is connected to the troffer housing 6 by a connection mechanism that allows the easy removal and reattachment of the lens assembly 2 to the troffer housing without the use of separate tools, fasteners or the like such as described previously with respect to FIGS. 11-15. Where one end cap is removable with the lens and one end cap is fixed to the troffer housing the removable end cap and lens may be considered the removable lens assembly 2. While in the illustrated embodiment the end cap 211 is removable and end cap 210 is fixed, end cap 211 may be fixed and end cap 210 may be removable.

Where one end cap is removable with the lens assembly 2 and one end cap is fixed to the troffer housing, the end caps may differ in the dimensions of the widths W (see FIG. 9) of the slots 40 as well as in the connection mechanism used to connect the fixed end cap and the removable end cap to the troffer housing. The width W of the slot 40 of the removable end cap 211 that is permanently attached to the lens 212 may be made narrower that the slot 40 of the fixed end cap 210 to allow the edge 232 of the lens 212 to be more easily inserted into the slot 40 of the fixed end cap 210 during installation of the lens assembly 2 into the troffer housing 6. To install the lens assembly 2 into the troffer housing 6 the lens assembly 2 is moved toward the troffer housing 6 at a slight angle to parallel to the troffer housing such that the free edge 232 of the lens 212 may be inserted into the slot 40 of the fixed end cap 210 as shown by arrow C in FIG. 27. Making the width W of the slot 40 of the fixed end cap 210 wider allows the free edge 232 of the lens 212 to be more easily inserted into the slot 40. The lens 212 is inserted into and fixed in slot 40 of the removable end cap 211 during manufacture of the light fixture such that the width W of the slot 40 on the removable end cap 211 may be made relatively narrower and may include the resilient locking members 42 to retain the end cap 211 on the lens 212.

Once the free edge 232 of the lens 212 is inserted into the slot 40 on the fixed end cap 210, the removable end cap 211 may be rotated toward the troffer housing 6 and secured to the troffer housing using a removable connection mechanism such as described above. It is noted that as the removable end cap 211 approaches the connection mechanism on the troffer housing the end cap 211 is moved substantially in the insertion direction B perpendicular to the troffer housing as previously described.

Figure 23:
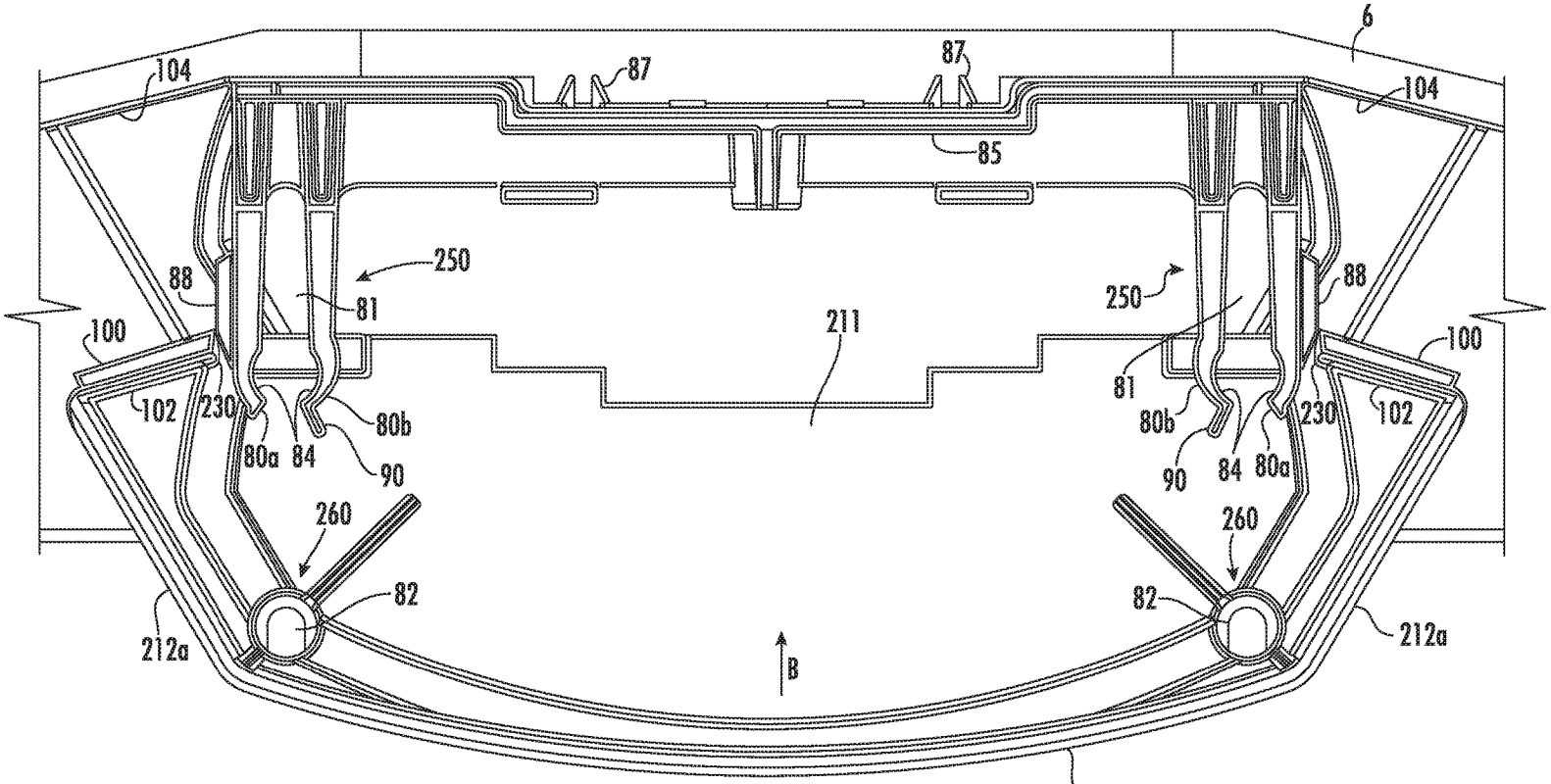
FIGS. 23-25 are partial section views showing the engagement of the engagement members on the troffer housing with the engagement members on the removable end cap.
Figure 24:
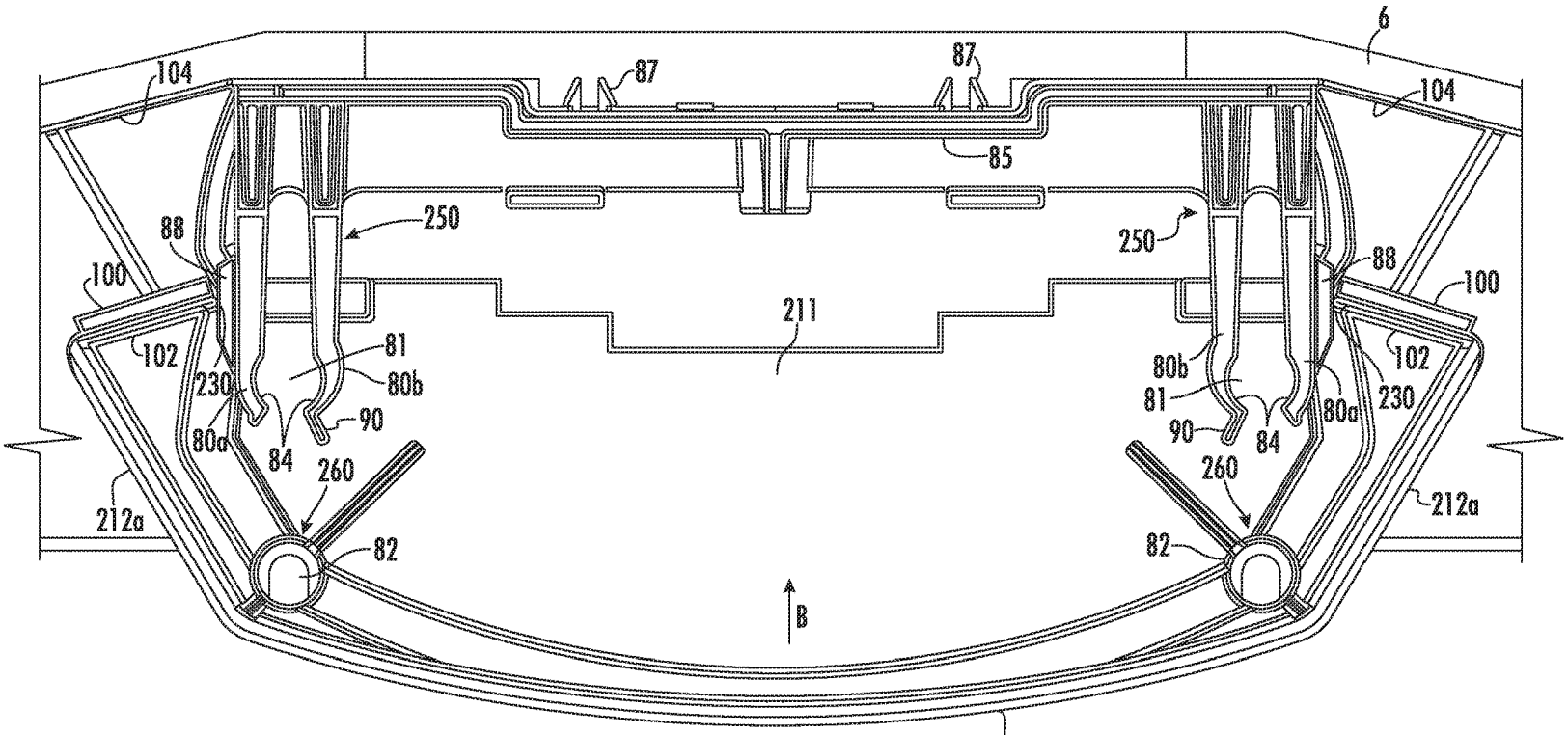
Figure 25:
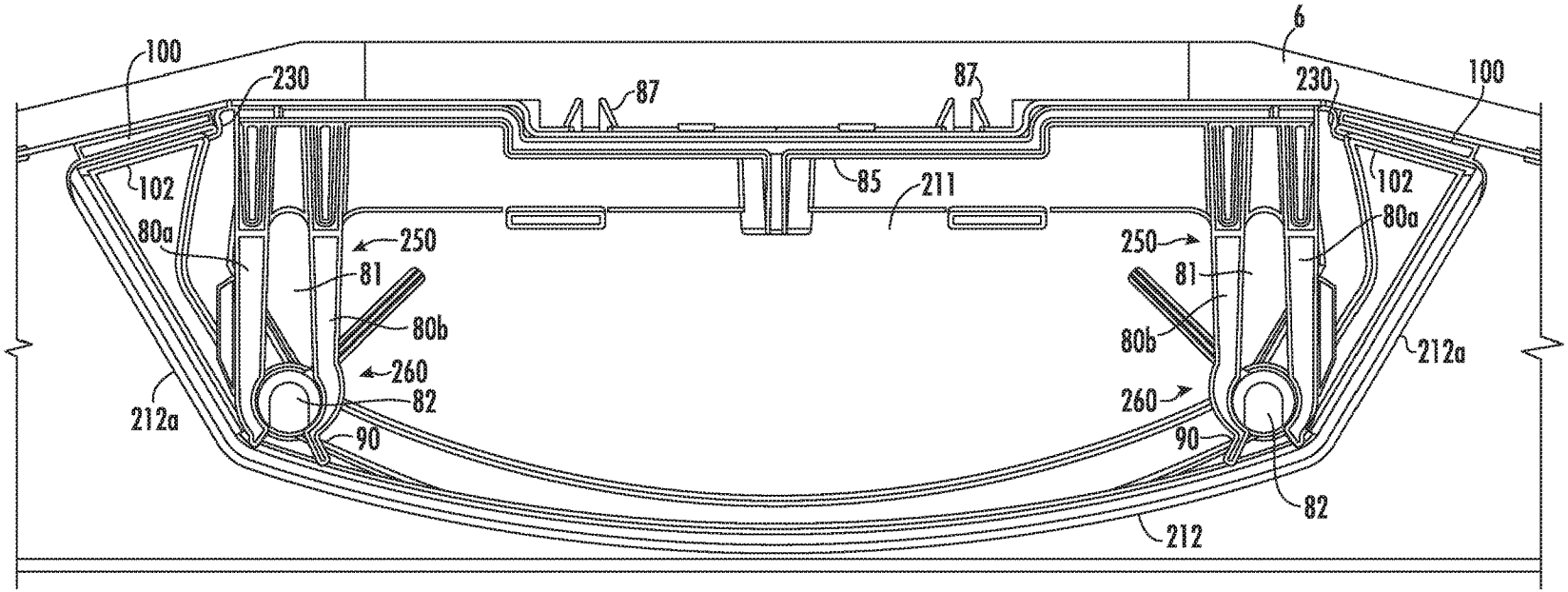
Figure 26:
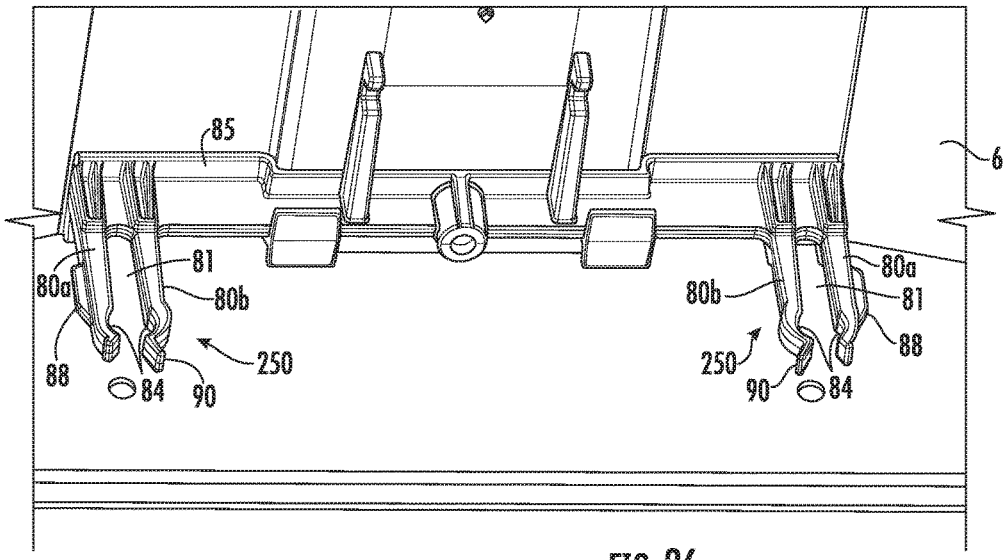
FIG. 26 is a perspective view of an alternate embodiment of engagement members mounted to the troffer housing.

In another embodiment of the releasable connection mechanism, the removable connection mechanism may comprise a first mounting structure 250 on the troffer housing 6 and a mating second mounting structure 260 on the removable end cap 211 as shown in FIGS. 23-26 and 28. While one each of the first mounting structure 250 and the mating second mounting structure 260 may be used, in some embodiments at least two of each of the mounting structures may be used to securely hold the lens assembly 2 to the troffer housing 6. The first mounting structure 250 may comprise at least one pair of resiliently deformable engagement members 80*a*, 80*b* that extend from the troffer housing 6. The engagement members 80*a*, 80*b* may be formed as a part of a clip 85 that is secured to the troffer housing 6 by deformable tangs 87 that engage apertures in the troffer housing 6. The pair of resilient engagement members 80*a*, 80*b* may comprise two opposed elongated members that face one another to form a gap 81 therebetween. The second mounting structure 260 comprises a rigid engagement member 82 on the removable end cap 211 provided for each pair of engagement members 80*a*, 80*b*. The rigid engagement member 82 is configured to fit between the members 80*a*, 80*b* and into the gap 81 when the lens assembly 212 is moved into position relative to the troffer housing 6 as shown in FIGS. 23-25. The gap 81 and rigid engagement member 82 are dimensioned such that the rigid engagement member 82 deforms the elongated members 80*a*, 80*b* away from one another to create a bias gripping force on the rigid engagement member 82 due to the resilient deformation of the elongated members 80*a*, 80*b*. The elongated members 80*a*, 80*b* may be formed with indentations 84 that are configured to receive the rigid engagement members 82 when the lens assembly 212 is seated in the troffer housing 6. The engagement of the rigid engagement members 82 with the indentations 84 creates a snap-fit connection that securely holds the lens assembly 2 in place in the troffer housing 6. In one embodiment the engagement member 82 is a cylindrical member and the mating indentations 84 are semicircular although other shapes may be used. The holding force is created by the friction force between the first engagement members 80*a*, 80*b* and the second engagement member 82 as well as by the mechanical engagement between the indentations 84 on the first engagement members 80*a*, 80*b* and the second engagement member 82. Both forces are generated by the resilient deformation of the first engagement members 80*a*, 80*b* into engagement with the second engagement member 82. While in the illustrated embodiment the first engagement members 80*a*, 80*b* on the troffer housing 6 are resilient and the second engagement member 82 on the removable end cap 211 is substantially rigid, the members may be reversed such that the first engagement member on the troffer housing 6 is rigid and the second engagement members on the end cap 211 is resilient and deformable. Moreover, both the first and second engagement members may be resiliently deformable.

The force created between the first and second engagement members is sufficient to hold the lens assembly 2 in the housing 6; however, the holding force is low enough that a user may remove the lens assembly 2 from the housing 6 by pulling the removable end cap 211 downwardly in a direction opposite to the insertion direction B.

In some embodiments the outboard engagement members 80*a* include a camming surface 88 that flexes the sides 212*a* of the lens 212 outwardly as the lens assembly is mounted in the troffer housing. The camming surfaces 88 comprise protrusions that extend outwardly laterally from members 80*a*. When the sides 212*a* of the lens clear the camming surfaces 88 the resiliency of the lens material flexes the sides 212*a* of lens 212 inwardly toward the unflexed position such that the ends 230 of the lens 212 may flex inwardly to firmly engage the troffer housing when the lens is fully mounted in the troffer housing. One or both of the members 80*a*, 80*b* may be formed with flared ends 90 to facilitate the engagement of the first and second mounting structures 250, 260 and allow "blind" installation of the lens assembly.

Thus, the lens assembly 2 including the lens 212 and the removable end cap 211 may be mounted in the troffer housing 6 by inserting the free end 232 of the lens 212 in the fixed end cap 210 in the direction of arrow C and rotating the lens assembly 2 to move the removable end cap 211 in a first insertion direction B relative to the troffer housing 6 and engaging the first mounting structure 250 with the second mounting structure 260. The lens assembly 2 may be easily removed from the housing 6 by moving the removable end cap in a second linear direction opposite to the insertion direction and disengaging the first engagement members from the second engagement members. The lens assembly 2 may be rotated away from the troffer housing 6 until the free edge 232 of the lens 212 may be removed from the fixed end cap 210.

In some embodiments the longitudinal edges 30 of the lens 12 may be secured to the troffer housing using a magnetic connection mechanism rather than inserting the longitudinal edges 30 of the lens into the slots or recesses 32 in the troffer housing 6 as previously described. Referring to FIGS. 19-22 magnetic strips 100 may be secured to the longitudinal edges 230 of the lens 212 that are configured to magnetically engage the troffer housing 6 along both longitudinal edges 230 of the lens 212. In one embodiment the longitudinal edges 230 of the lens 212 may be formed with flat faces 102 that extend for the length of the lens 212 to define longitudinal edges 230 and form support surfaces for receiving the magnetic strips 100. Because troffer housings are typically made of a ferromagnetic material such as steel the magnetic strips 100 will adhere to the exposed surfaces of the troffer housing. In some embodiments the troffer housing is formed with two flat mating surfaces 104 that extend parallel to and in an abutting relationship with the magnetic strips 100 when the lens assembly 2 is mounted in the troffer housing 6 to create a smooth uninterrupted surface for the magnetic strips 100 to adhere to. The engagement of the magnetic strips 100 with the troffer housing 6 provides an uninterrupted secure seal between the lens assembly 2 and the troffer housing 6 that prevents, dirt, insects or the like from entering the lens assembly. The magnetic strips 100 may be secured to the lens 212 in any suitable manner. In one embodiment the magnetic strips 100 are secured to the lens 212 by adhesive, adhesive tape or the like such that no openings or gaps are formed between the magnetic strips 100 and the lens 212.

In one embodiment the magnetic strip 100 comprises a high energy permanent magnet 106. The magnet 106 may be approximately 30 mils thick such that the magnetic strip 100 has some flexibility to accommodate surface variations in the planarity of the troffer housing. The magnet 106 is formed as a strip that extends for substantially the length of the longitudinal edges 230. The front surface 106*a* of the magnet 106 may be covered in a protective coating. Because the front surface 106*a* of the magnet 106 may be visible after the lens 212 is mounted in the troffer housing 6, a reflective white layer 108 may cover the exposed surface 106*a*. In one embodiment the reflective white layer 108 comprises a strip of white polyethylene foam that covers the magnet 106. The strip of foam may be attached to the magnetic strip such that the white foam material faces the interior space 4 when the lens assembly 2 is attached to the troffer housing 6. A layer 110 of clear two-sided adhesive tape or adhesive may be used to attach the foam layer 108 to the magnet 106 and a second layer 112 of clear two-sided adhesive tape or adhesive may be used to attach the foam layer 108 to the lens 212. In addition to providing a white reflective surface the use of the foam layer provides a deformable layer that allows the magnetic strip to conform to variations and irregularities in the troffer housing to create a seal between the troffer housing and the lens. The seal may be provided at any areas of the assembly where the lens abuts or is adjacent to the troffer. In some embodiments the foam layer may be eliminated such that the magnetic strip comprises only the magnet 106 where the magnet 106 is attached to the lens 212 without the intermediate foam layer 108. The reflective white surface of the magnetic strip 100 may be provided by other than a foam strip 108 such as by using a white and/or reflective paint or other coating on the magnetic strip, by using white adhesive to attach the magnetic strip to the lens or by using a reflective layer other than foam or by using multiple layers.

Because the troffer housing 6 is typically made of a ferromagnetic material, the magnetic strip 100 on the lens may be secured to any surface of the troffer housing that provides a relatively smooth uninterrupted mating surface 104 to the magnetic strip. While a typical troffer housing is made of a ferromagnetic material such as steel, to the extent the troffer housing is made of a non-ferromagnetic material the mating surface 104 may comprise a ferromagnetic material attached to the troffer housing.

In some embodiments the locations of the magnetic strips 100 and the mating surfaces 104 may be reversed such that the magnetic strips 100 are attached to the troffer housing 6 and the mating ferromagnetic surfaces 104 are formed on the lens. In such an embodiment the magnetic strips may be secured to the troffer housing by adhesive, welds, fasteners, rivets, crimping, snap-fit connectors or the like and the ferromagnetic mating surface may be secured to the lens such as by using an adhesive.

In some embodiments using an uninterrupted magnetic strip 100 and an uninterrupted mating surface 104 provides a seal between the lens 212 and the troffer housing 5 along the entire length of the longitudinal edges 230 of the lens 212 to prevent debris and insects from entering space 4. Uninterrupted as used herein means that the magnetic strip 100 and mating surface 104 extend for the length of the lens that is adjacent to or abuts the troffer housing; however, the magnetic strip and mating surface may be made of multiple components arranged end-to-end in an abutting relationship or the components may be made of a single component that extends the entire length. While in a preferred embodiment the magnetic strip and mating surface are uninterrupted for the length of the lens, in some embodiments the magnetic strip and/or the mating surface may be segmented such that they do not extend in an uninterrupted fashion for the length of the lens. In such an embodiment a tight seal may not be created between the lens and the troffer housing over the entire length of the longitudinal edges 230 such that debris and/or insects may enter space 4. In addition to forming a seal between the lens and the troffer housing the magnetic connection also assists in securing the lens assembly 2 to the troffer housing.

Figure 29:
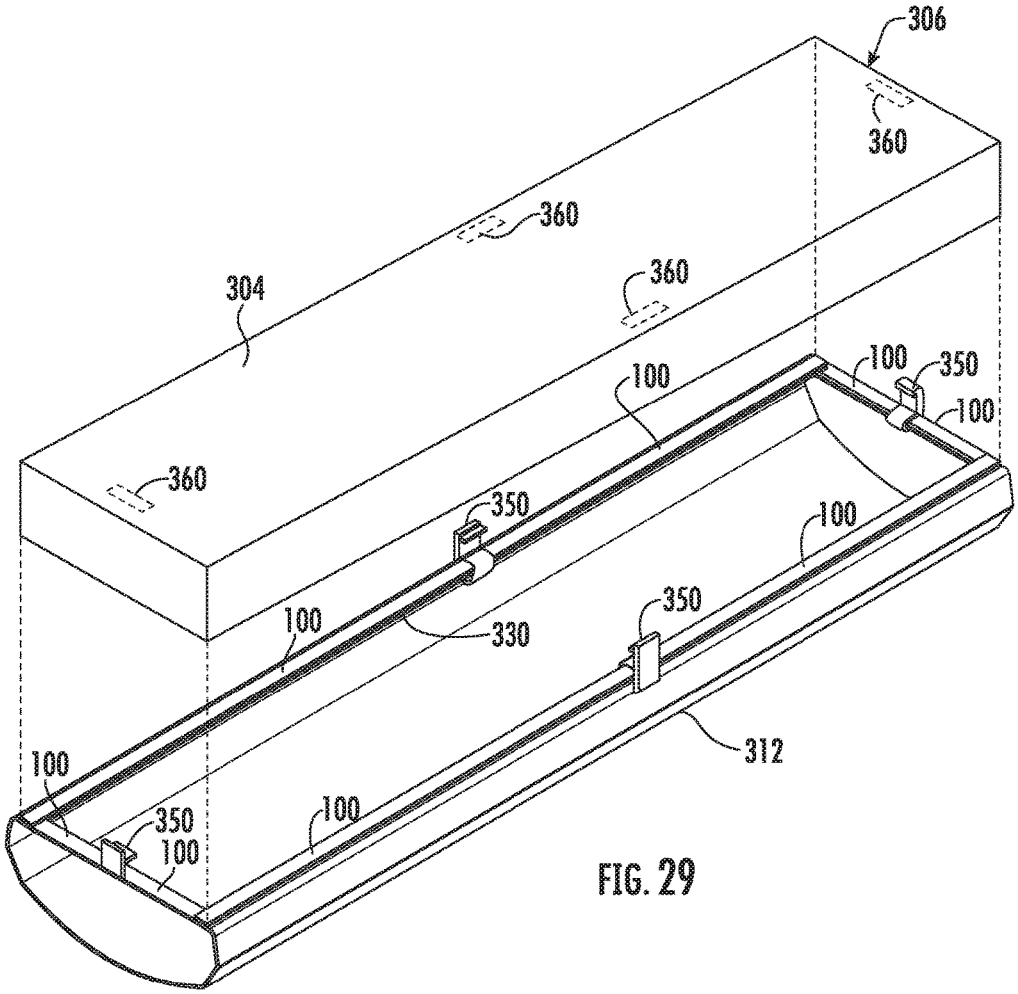
FIGS. 29-31 are perspective views showing an alternative embodiments of the arrangement of the magnetic strips on a lens.

The magnetic strip 100 and mating surface 104 on the housing extend for the length of the lens that is adjacent to or abuts the housing. In some embodiments the magnetic seal may be used with a lens that is mounted on a housing other than the troffer housing described above. In such an embodiment the lens may be secured to the housing without the use of end caps. One example lens 312 is shown in FIG. 29 that has a peripheral edge 330 that extends for substantially the entire periphery of the open end of the lens and that is disposed adjacent to or abutting the mating light fixture housing 306. Housing 306 has a mating surface 304 that is closely adjacent to or in an abutting relationship with the magnetic strips 100 such that the magnetic strips form a seal with the mating surface 304 as described above. The magnetic strips 100 may be located at any portion of the open end of the lens edge 330 that is adjacent the housing 306 to form a seal therewith. In the embodiment of FIG. 29 the magnetic strips extend for substantially the entire peripheral edge 330 of the lens except in the areas where the mounting structures 350 are located. Mounting structures 350 are releasably secured to mating mounting structures 360 on the housing 306 to releasably attach the lens to the housing. The mounting structures may comprise a resilient member or members that engage a stationary mating member as previously described and may comprise any suitable attachment mechanism for attaching the lens to the housing. By locating the magnetic strips along the entire periphery of the lens except where the mounting structures 350 are located provides a seal between the housing surface 304 and the edge of the open edge of the lens 330. The magnetic strips provide a seal as described and the mating mounting structures provide an effective seal where the mounting structures are located.

Figure 30:
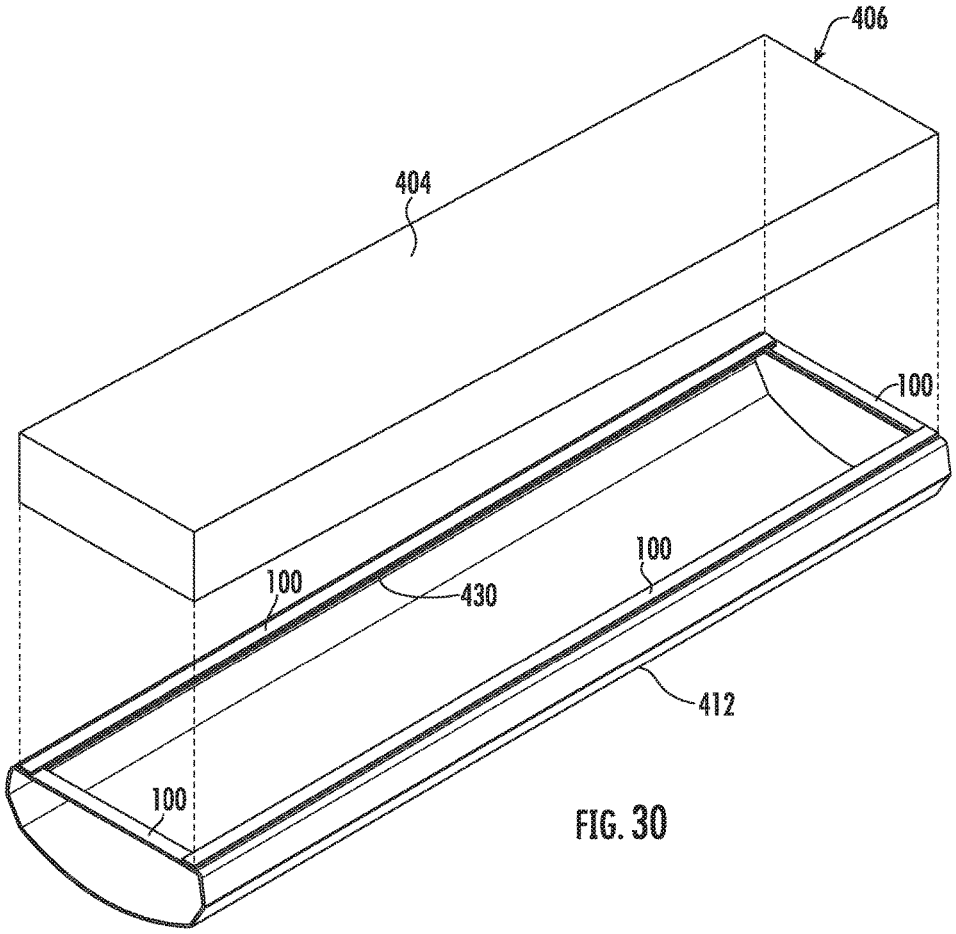

Another example lens 412 is shown in FIG. 30 that has a peripheral edge 430 that extends for substantially the entire periphery of the open end of the lens and that is disposed adjacent to or abutting the mating light fixture housing 406. Housing 406 has a mating surface 404 that is closely adjacent to or in an abutting relationship with the magnetic strips 100 such that the magnetic strips form a seal with the mating surface 404 as described above. The magnetic strips 100 may be located at any portion of the open end of the lens edge 430 that is adjacent the housing 406 to form a seal therewith. In the embodiment of FIG. 30 the magnetic strips extend for substantially the entire peripheral edge 430 of the lens and is uninterrupted for the entire peripheral edge. The engagement of magnet strips 100 with the mating surface 404 of housing 406 forms a seal around the entire open periphery of the lens 412. In the embodiment of FIG. 30 the magnet strips 100 may also be used without a mechanical mounting structure such that the magnetic strips retain the lens on the housing 406.

Figure 31:
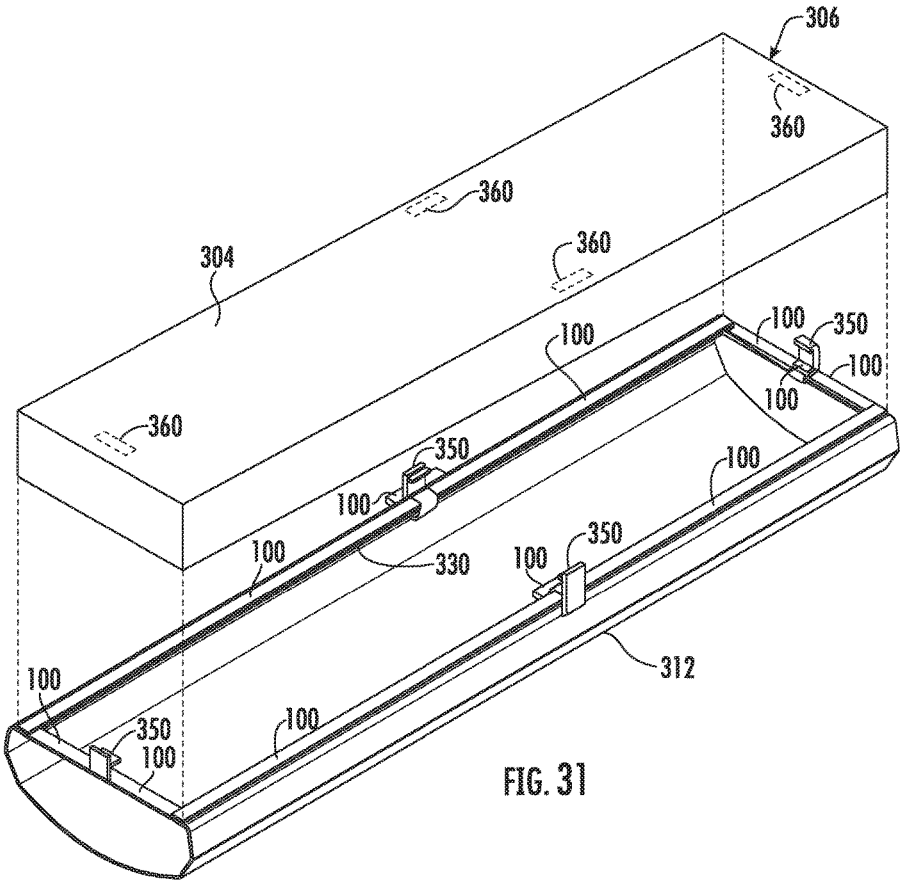

In some embodiments an attachment mechanism such as described with respect to FIG. 29 may be used and a magnetic strip that extends for the entire periphery of the lens as described with respect to FIG. 30 may be used together. In such an embodiment the magnetic strips and the mating surface 304, 404 may extend over, outside or inside of the mounting structures 350 such that the magnetic strips 100 extend uninterrupted about the open periphery of the lens as shown in FIG. 31.

While the lenses described herein are shown as rectangular any of the lenses as shown and described herein and the mating housings may have any suitable shapes including but not limited to round oval or the like and may be of any suitable décor and/or suitable for any lighting environment including commercial, residential, industrial or the like. Moreover as previously described magnetic strip 100 and mating surface 104 may be made of multiple components arranged end-to-end in an abutting relationship or the components may be made of a single component that extends the entire length. Additionally, other components may be interposed between the magnetic strips and the lens such that the magnetic strips may be attached to the intermediate components rather than directly to the lens. For example, decorative rings may be attached to the peripheral edge of the lens and the magnetic strips may be attached to the decorative ring rather than directly to the lens. Such an arrangement provides the desired seal provided that the intermediate components are sealingly attached to the lens.

For lamps provided with Smart Cast technology at least one of the end panels 16 may be provided with a communication component housing 70 for receiving the Smart Cast components such as sensors, RF devices or other electronics. The communication component housing 70 including an aperture 73 that allows the components in the housing access to the exterior of the housing. The communication component housing 70 is secured to the end panel 16 such that a space 71 is created between the surface 16*a* of end panel 16 and the communication component housing 70. In one embodiment pairs of slots 75 are provided in the end panel 16 that receive tabs 77 formed on the communication component housing 70 to position the communication component housing 70 relative to aperture 48 in end cap 10. The tabs 77 and slots 75 are configured in one embodiment such that a snap-fit connection is created between the housing and the end panel 16. In other embodiments the communication component housing 70 may be secured to the end panels 16 using any suitable connection mechanism such as welding, crimping, separate fasteners or the like; however, using a snap-fit connection allows the communication component housing 70 to be snap-fit to the end panel and the lens assembly to be snap-fit into the housing to facilitate assembly of the lamp. The end cap 10 that is positioned adjacent the communication component housing 70 includes a recessed area 46 (FIG. 11) for receiving the communication component housing 70 such that the aperture 48 in the end cap 10 is in communication with the aperture 73 of the communication housing 70 such that the electronics contained in the communication component housing 70 may be positioned adjacent and the aperture 48 and be communication the exterior of the lamp.

Although specific embodiments have been shown and described herein, those of ordinary skill in the art appreciate that any arrangement, which is calculated to achieve the same purpose, may be substituted for the specific embodiments shown and that the invention has other applications in other environments. This application is intended to cover any adaptations or variations of the present invention. The following claims are in no way intended to limit the scope of the invention to the specific embodiments described herein.

The invention claimed is:

1. A troffer light fixture, comprising:

a LED assembly comprising at least one LED operable to emit light when energized through an electrical path;

a housing supporting the LED assembly, the housing comprising a first end cap permanently connected to the housing; and a lens assembly comprising a lens covering the at least one LED and a second end cap, the lens having a first end releasably connected to the first end cap and a second end permanently connected to the second end cap, the second end cap being releasably connected to the housing such that the lens and the second end cap are releasably mounted to the housing as a unit and the lens is releasably mounted to the first end cap.

2. The light fixture of claim 1, wherein the lens comprises a first longitudinal edge and a second longitudinal edge where a first magnetic strip is attached to the first longitudinal edge and a second magnetic strip is attached to the second longitudinal edge.

3. The light fixture of claim 2, wherein the first magnetic strip and the second magnetic strip are magnetically adhered to the housing.

4. The light fixture of claim 2, wherein the first magnetic strip and the second magnetic strip extend uninterrupted for the length of the first longitudinal edge and the second longitudinal edge adjacent the housing.

5. The light fixture of claim 2, wherein the first magnetic strip and the second magnetic strip each comprise a magnet and a reflective layer.

6. The light fixture of claim 5, wherein the reflective layer comprises a polyethylene foam.

7. The light fixture of claim 1, wherein the second end cap is releasably mounted to the housing by a pair of deformable, resilient first engagement members on one of the housing and the second end cap that releasably engages a second engagement member on the other one of the housing and the second end cap.

8. The light fixture of claim 7, wherein the second engagement member comprises a rigid member.

9. A light fixture, comprising:

a LED assembly comprising at least one LED operable to emit light when energized through an electrical path;

a housing supports the LED; and a lens covering the at least one LED, the lens having a peripheral edge where a magnetic strip is attached to the peripheral edge to form a seal with the housing wherein the magnetic strip comprises a magnet and a reflective white layer, the reflective white layer being coextensive with the magnet and being disposed between the magnet and the lens, the lens having a first end releasably connected to a first end cap and a second end permanently connected to a second end cap.

10. The light fixture of claim 9, wherein the magnetic strip is magnetically adhered to the housing.

11. The light fixture of claim 9, wherein the magnetic strip extends substantially uninterrupted for the length of the peripheral edge.

12. The light fixture of claim 11, wherein the magnetic strip extends uninterrupted for the length of the peripheral edge.

13. The light fixture of claim 11, wherein a mounting mechanism attaches the lens to the housing and the magnetic strip extends uninterrupted for the length of the peripheral edge except where the mounting mechanism is located.

14. The light fixture of claim 9, wherein the reflective layer comprises a polyethylene foam.

15. A troffer light fixture, comprising:

a LED assembly comprising at least one LED operable to emit light when energized through an electrical path;

a housing supporting the LED assembly;

a lens covering the at least one LED, the lens having a first end releasably connected to a first end cap and a second end permanently connected to a second end cap and a first longitudinal edge and a second longitudinal edge extending between the first end and the second end where a first magnetic strip is attached to the first longitudinal edge and a second magnetic strip is attached to the second longitudinal edge wherein the first magnetic strip and the second magnetic strip each comprise a magnet and a reflective layer and the reflective layer comprises a deformable, compressible layer where the first magnetic strip and the second magnetic strip are magnetically adhered to the housing, the magnet being of sufficient energy that the deformable, compressible layer is at least partially deformed and compressed between the magnet and the housing.

16. The light fixture of claim 15, wherein the first magnetic strip and the second magnetic strip extend uninterrupted for the length of the first longitudinal edge and the second longitudinal edge.

17. The light fixture of claim 15, wherein the deformable layer comprises a polyethylene foam.

* * * * *